US007758375B2

(12) United States Patent
Moriyama et al.

(10) Patent No.: US 7,758,375 B2
(45) Date of Patent: Jul. 20, 2010

(54) BALANCED TRANSMISSION CABLE CONNECTOR

(75) Inventors: Satoshi Moriyama, Shinagawa (JP); Takeshi Okuyama, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 12/488,645

(22) Filed: Jun. 22, 2009

(65) Prior Publication Data

US 2010/0099299 A1 Apr. 22, 2010

(30) Foreign Application Priority Data

Oct. 17, 2008 (JP) ..... 2008-268263

(51) Int. Cl.
*H01R 12/24* (2006.01)

(52) U.S. Cl. ..... 439/497; 439/660; 439/607.01; 439/607.02

(58) Field of Classification Search ..... 439/101, 439/497, 499, 607.01, 607.02, 660
See application file for complete search history.

(56) References Cited

U.S. PATENT DOCUMENTS 7,223,121 B2 * 5/2007 Moriyama et al. ..... 439/497
2006/0270271 A1 11/2006 Moriyama et al.

FOREIGN PATENT DOCUMENTS

JP 2007-12588 A 1/2007

* cited by examiner

*Primary Examiner*—Javaid Nasri
(74) *Attorney, Agent, or Firm*—IPUSA, PLLC

(57) ABSTRACT

A balanced transmission cable connector includes a balanced transmission cable including a plurality of pair electric wires, each of the pair electric wires including a first signal wire, a second signal wire, and a drain wire; a contact assembly body having an insulative block body where first and second signal contacts and a ground contact are alternately arranged in a row direction, the first and second signal contacts facing each other in a line direction, the block body having a rear surface side where first and second signal wire connecting parts being parts of the first and second signal contacts and a drain wire connecting part and a plate-shaped part being a part of the ground contact project; a first groove part where the first signal wire connecting part is provided; a second groove part where the second signal wire connecting part is provided; a slit and an insulative spacer.

5 Claims, 22 Drawing Sheets

FIG.1 REALTED ART

RELATED
ART

RELATED
ART

BALANCED TRANSMISSION CABLE CONNECTOR

CROSS-REFERENCE TO RELATED APPLICATIONS

This patent application is based upon and claims the benefit of priority of Japanese Patent Application No. 2008-268263 filed on Oct. 17, 2008, the entire contents of which are incorporated herein by reference.

BACKGROUND OF THE INVENTION

1. Field of the Invention

The present invention generally relates to cable connectors. More specifically, the present invention relates to a balanced transmission cable connector where first signal contacts, second signal contacts and ground contacts are arranged in an insulative block body. Here, the first signal contacts and the second signal contacts face each other in a line (vertical) direction. The first signal contacts/the second signal contacts and the ground contacts are alternately arranged in a row direction. The first signal contact, the second signal contacts and the ground contacts are connected to first signal wires, second signal wires and drain wires, respectively, of ends of the balanced transmission cable.

2. Description of the Related Art

As ways for transmitting data, there are a normal transmission type and a balanced transmission type. In the normal transmission type, a single electric wire is used for every data stream. In the balanced transmission type, two electric wires which form a couple for every data stream are used so that a positive signal and a negative signal having the same size as that of the positive signal but having a different direction from that of the positive signal are simultaneously transmitted. The balanced transmission type, compared to the normal transmission type, has an advantage in that there may not be noise influence. Accordingly, the balanced transmission type has been widely used in fields where signals are transmitted at a high speed.

In the meantime, FIG. 1 is a perspective view schematically illustrating a related art balanced transmission cable connector. FIG. 2 is an exploded perspective view of the balanced transmission cable connector illustrated in FIG. 1. FIG. 3 is a cross-sectional view of a balanced transmission cable 20. FIG. 4 is a view illustrating a connection part of an end of the balanced transmission cable 20 and a contact assembly body 51. FIG. 4(A) is a perspective view and FIG. 4(B) is a cross-sectional view taken along a line A-A.

In FIG. 1 through FIG. 4, "X1-X2" indicates a width direction, "Y1-Y2" indicates a longitudinal direction, and "Z1-Z2" indicates a height direction, of the balanced transmission cable connector.

The balanced transmission cable includes, as illustrated in FIG. 1 and FIG. 2, the balanced transmission cable 20, the connector assembly body 51, a pair of lock arms 56 and 57, a spacer 60, a shield cover assembly body 80, a hood 100, an outer cover 110, and an inner cap 400. See, for example, Japanese Laid Open Patent Application Publication No. 2007-12588.

The balanced transmission cable 20 includes, as illustrated in FIG. 3, plural pair electric wires 21. Plural pair electric wires 21 are provided inside a tube having a double covering structure formed of an external covering 27 and a shield mesh line 28. Insulative covering signal electric wires 22-1 and 22-2 forming a pair for balanced signal transmission and the drain wire 25 are bundled by a metal tape winding around the insulative covering signal electric wires 22-1 and 22-2 and the drain wire 25 in a spiral manner, so that each of the pair electric wires 21 is shielded. The insulative covering signal electric wires 22-1 and 22-2 and the drain wire 25 extend outside from an end of each of the pair electric wires 21. Head ends of the insulative covering signal electric wires 22-1 and 22-2 are processed so that a first signal wire 23-1 and a second signal wire 23-2 are exposed.

As illustrated in FIG. 4, in an insulative block body 52 of the contact assembly body 51, a first signal contact 53, a second signal contact 54 and a ground contact 55 are alternately arranged in a row direction (X1-X2 direction). The first signal contact 53 and the second signal contact 54 face each other in a line direction (Z1-Z2 direction). In addition, Y1 side ends of the lock arms 56 and 57 are provided one at each end in the X1-X2 direction of the block body 52.

The first signal contact 53 and the second signal contact 54 include a first signal wire connecting part 53*c* and a second signal wire connecting part 54*c*, respectively. The first signal wire connecting part 53*c* and the second signal wire connecting part 54*c* project to a rear surface side (Y2 side) of the block body 52. The first signal wire connecting part 53*c* and the second signal wire connecting part 54*c* have L-shaped cross-sectional configurations.

The ground contact 55 includes a plate-shaped part 55*c* and a drain wire connecting part 55*d*. The plate-shaped part 55*c* projects to the rear surface side (Y2 side) of the block body 52. The drain wire connecting part 55*d* includes three lugs 55*d*1, 55*d*2, and 55*d*3. The lugs 55*d*1, 55*d*2, and 55*d*3 are alternately bent in the X1 direction and the X2 direction to have a U-shaped configuration seen from the Y2 side.

A spacer 60 is provided at the rear surface side (Y2 side) of the block body 52 to determine positions of the first wire connecting part 53*c*, the second wire connecting part 54*c* and the plate-shaped part 55*c*. The spacer 60 includes a first groove part 61, a second groove part 62, and a slit 63. The first groove part 61 corresponds to the first signal wire connecting part 53*c*. The second groove part 62 corresponds to the second signal wire connecting part 54*c*. The slit 63 corresponds to the plate-shaped part 55*c*.

As discussed above, the first signal wire connecting part 53*c* and the second signal wire connecting part 54*c* have L-shaped cross-sectional configurations. Therefore, each of the signal wires 23-1 and 23-2 are soldered so that the signal wires 23-1 and 23-2 are positioned at corner parts at insides of the first wire connecting part 53*c* and the second wire connecting part 54*c*, respectively.

In addition, the drain wire connecting part 55*d* has a U-shaped configuration. Therefore, the drain wire 25 is positioned by and soldered to the drain wire connecting part 55*d*.

With this structure, it is possible to directly connect the first signal wire 23-1 and the second signal wire 23-2 to the first signal contact 53 and the second signal contact 54 without using a relay board. Hence, it is possible to reduce cross-talk.

FIG. 5 is an exploded perspective view of an inner cap 400 and a shield assembly body 80. FIG. 6 is a view illustrating a gap between the inner cap 400 and the shield assembly body 80 that is closed. In FIG. 6, part (A) is a view seen from the Y2 side. Part (B) of FIG. 6 is a cross-sectional view taken along a line B-B of part (A). Part (C) of FIG. 6 is a cross-sectional view taken along a line C-C of part (A).

The shield assembly body 80 is formed by arranging a first shield cover 81 situated at a Z1 side and a second shield cover 90 situated at a Z2 side. The shield assembly body 80 surrounds the contact assembly body 51, the pair of the lock arms 56 and 57, and the spacer 60.

As illustrated in FIG. 2, the inner cap 400 is provided at the Y2 side of the inside of the shield assembly body 80. Under this structure, when the hood 100 and the outer cover 110 are outsert molded at the shield assembly body 80, it is possible to prevent resin from flowing from a space at the Y2 side of the shield assembly body 80 to the inside.

The inner cap 400 is formed by arranging a first inner cap half 401 at the Z1 side and a second inner cap half 410 at the Z2 side.

The first inner cap half 401 includes a base board part 402 situated at the Z1 side, a pair of engaging parts 403 and 404 situated at the X1 side and the X2 side, respectively, and a back board part 405 situated at the Y2 side.

The engaging parts 403 and 404 include ribs 403*c*, 403*d*, 404*c*, and 404*d* situated at external surfaces of the engaging parts 403 and 404. The ribs 403*c* and 403*d* and the ribs 404*c* and 404*d* extend in the Z1-Z2 direction in a line manner over the full height. The ribs 403*c* and 404*c* come in contact with an internal surface of the second shield cover 90 with a pressure (force). The ribs 403*d* and 404*d* come in contact with an internal surface of the first shield cover 81 with a force.

The back board 405 includes a window part 405*b* having a substantially semicircular-shaped configuration. The balanced transmission cable 20 is inserted into the window part 405*b*.

The second inner cap half 410 includes a base board part 411 and a pair of facing parts 412 and 413.

External surfaces of the pair of facing parts 412 and 413 face corresponding internal surfaces of the pair of the engaging parts 403 and 404 with separation. In spaces 421 and 422 between the external surfaces of the facing parts 412 and 413 and the internal surfaces of the engaging parts 403 and 404, Y2 side ends of the corresponding lock arms 56 and 57 are received. The balanced transmission cable 20 is inserted into the space 414 between the facing parts 412 and 413.

Thus, the ribs 403*c*, 403*d*, 404*c*, and 404*d* provided at the external surface of the inner cap 400 are in contact with the internal surface of the shield cover assembly 80 with a force, and thereby the spaces between the X1 side surface and the X2 side surface of the inner cap 400 and the X2 side surface and the X1 side surface of the shield assembly body 80 are closed.

In addition, a window part 97*b* at the Y2 side of the shield cover assembly 80 is closed by the balanced transmission cable 20 and the back board 405 of the first inner cap half 401.

According to the above-discussed structure, a space at the Y2 side of the shield cover assembly 80 can be closed. Therefore, it is possible to prevent resin from flowing to the inside of the shield cover assembly body 80 when the hood 100 and the outer cover 110 are outsert molded.

Last, an assembling process of the balanced transmission cable connector is discussed with reference to FIG. 7. Here, FIG. 7 is a perspective view illustrating a part of the assembling process of the balanced transmission cable connector illustrated in FIG. 7.

First, the first inner cap half 401 is placed inside the first shield cover 81. Then, while the end of the balanced transmission cable 20 is clamped by the ring part 85, as illustrated in FIG. 7, the contact assembly body 51 connected to the end of the balanced transmission cable 20 is installed inside the first shield cover 81 from the Y2 side in the Y1 direction.

Next, the second inner cap half 410 is combined with the first inner cap half 401 so that the inner cap 400 is assembled. Finally, the second inner cap half 410 is covered with the second shield cover 90 in order to be engaged with the first shield cover 81 and thereby the shield cover assembly 80 is assembled.

However, according to the structure discussed at Japanese Laid Open Patent Application Publication No. 2007-12588, as illustrated in FIG. 4(B), the drain wire connecting part 55*d*, the first signal wire connecting part 53*c*, and the second signal wire connecting part 54*c* are exposed from the spacer 60. Accordingly, at the time of soldering, the drain wire connecting part 55*d* and the first and second signal wire connecting parts 53*c* and 54*c* may be soldered in error. Hence, there is room for improvement of soldering operations.

In addition, as illustrated in FIG. 4(B), there are a lot of air layers around the first and second signal wire connecting parts 53*c* and 54*c*. Accordingly, characteristic impedance may be higher than a standard value.

Furthermore, according to the structure discussed at Japanese Laid Open Patent Application Publication No. 2007-12588, a window part 405*b* of the first inner cap half 401 installed in the first shield cover 81 is smaller than the space between the pair of the lock arms 56 and 57. Therefore, as illustrated in FIG. 7, it is necessary to elastically deform the pair of the lock arms 56 and 57 at the time of operations. Hence, there is room for improvement of assembling operations.

SUMMARY OF THE INVENTION

Accordingly, embodiments of the present invention may provide a novel and useful cable connector solving one or more of the problems discussed above.

More specifically, the embodiments of the present invention may provide a cable connector whereby soldering operations and characteristic impedance can be improved. The embodiments of the present invention may also provide a cable connector whereby it is possible to prevent outsert molding resin from flowing inside a shield cover assembly body and assembly operations can be improved.

Another aspect of the present invention may be to provide a balanced transmission cable connector, including:

a balanced transmission cable including a plurality of pair electric wires, each of the pair electric wires including a first signal wire, a second signal wire, and a drain wire;

a contact assembly body having an insulative block body where first and second signal contacts and a ground contact are alternately arranged in a row direction, the first and second signal contacts facing each other in a line direction, the block body having a rear surface side where first and second signal wire connecting parts being parts of the first and second signal contacts and a drain wire connecting part and a plate-shaped part being a part of the ground contact project;

a first groove part where the first signal wire connecting part is provided;

a second groove part where the second signal wire connecting part is provided;

a slit where the plate-shaped part is provided; and an insulative spacer provided at the rear surface side of the block body;

wherein the first signal wire connecting part and the second signal wire connecting part include side plate parts facing side surfaces of the first groove part and the second groove part, respectively, with separation;

the first signal wire connecting part and the second signal wire connecting part are arranged and positioned between the side plate parts of the first signal wire connecting part and the second signal wire connecting part and the side surfaces of the first groove part and the second groove part, respectively;

the drain wire connecting part includes a side plate part facing a side surface of the slit with separation; and the drain wire is arranged and positioned between the side plate part of the drain wire connecting part and the side surface of the slit.

According to the embodiments of the present invention, it is possible to provide a cable connector whereby soldering operations and characteristic impedance can be improved. It is also possible to provide a cable connector whereby it is possible to prevent outsert molding resin from flowing inside a shield cover assembly body and assembly operations can be improved.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

Figure 1:
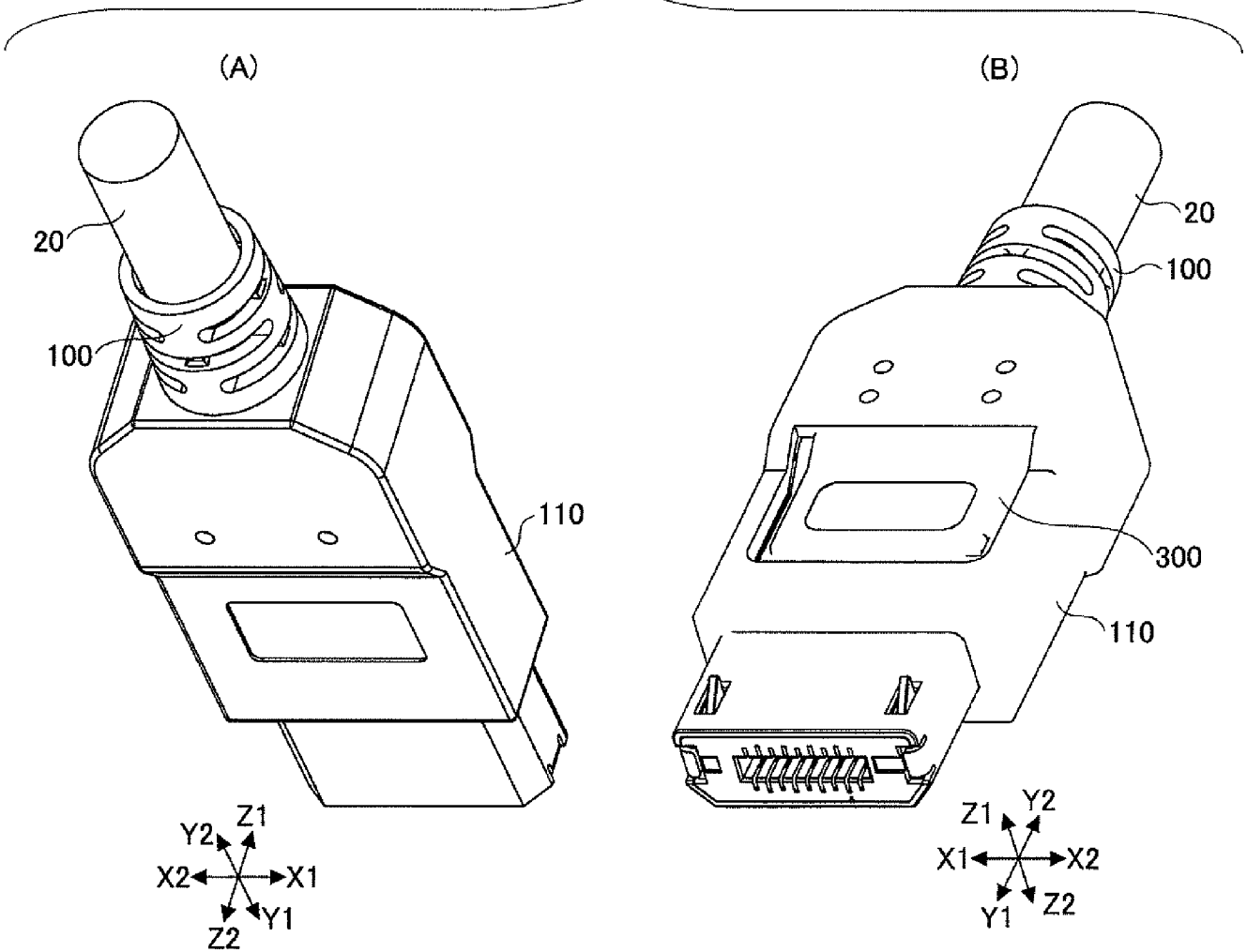
FIG. 1 is a perspective view schematically illustrating a related art balanced transmission cable connector.
Figure 2:
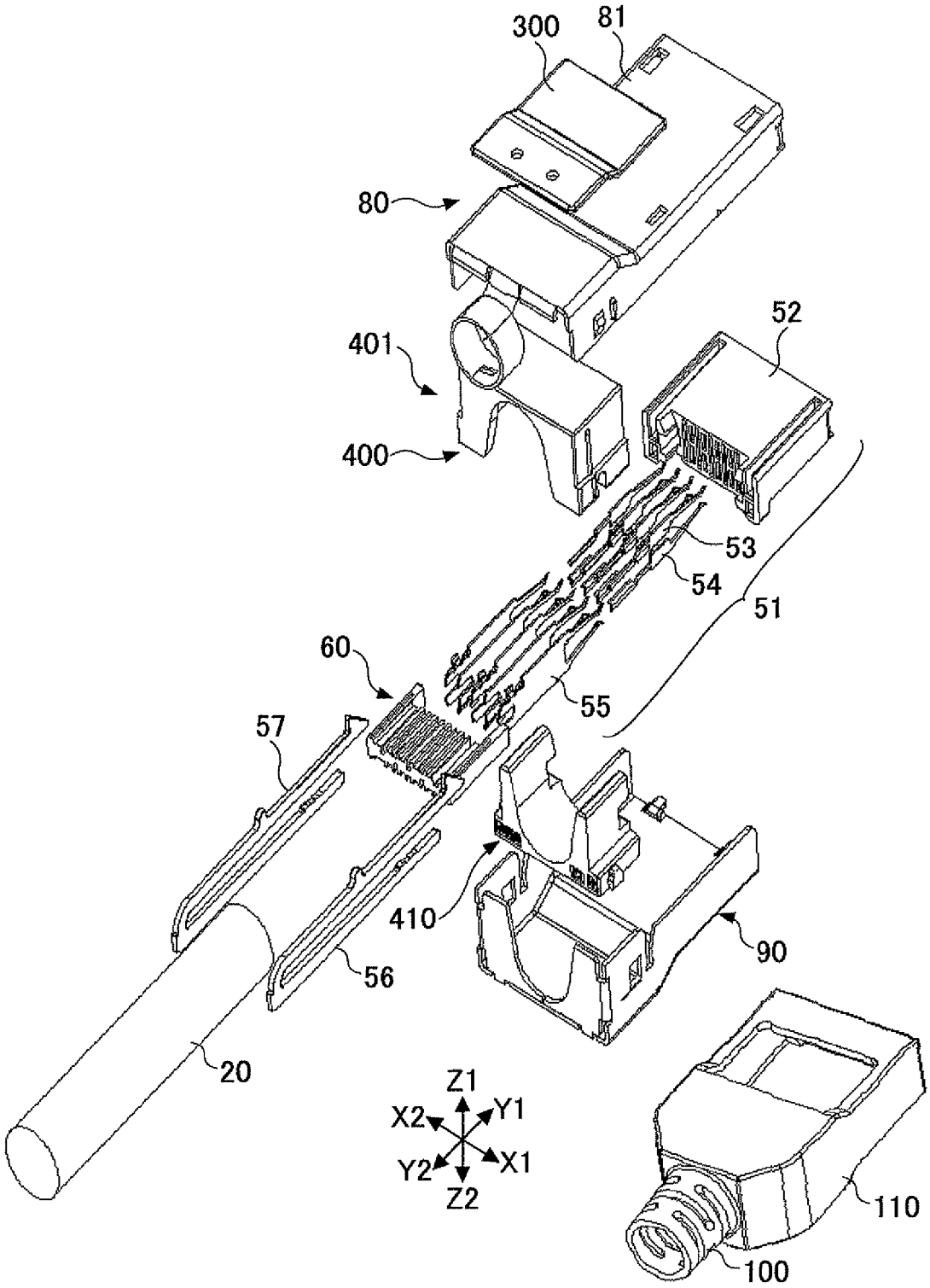
FIG.2 RELATED ART
FIG. 2 is an exploded perspective view of the balanced transmission cable connector illustrated in FIG. 1.
Figure 3:
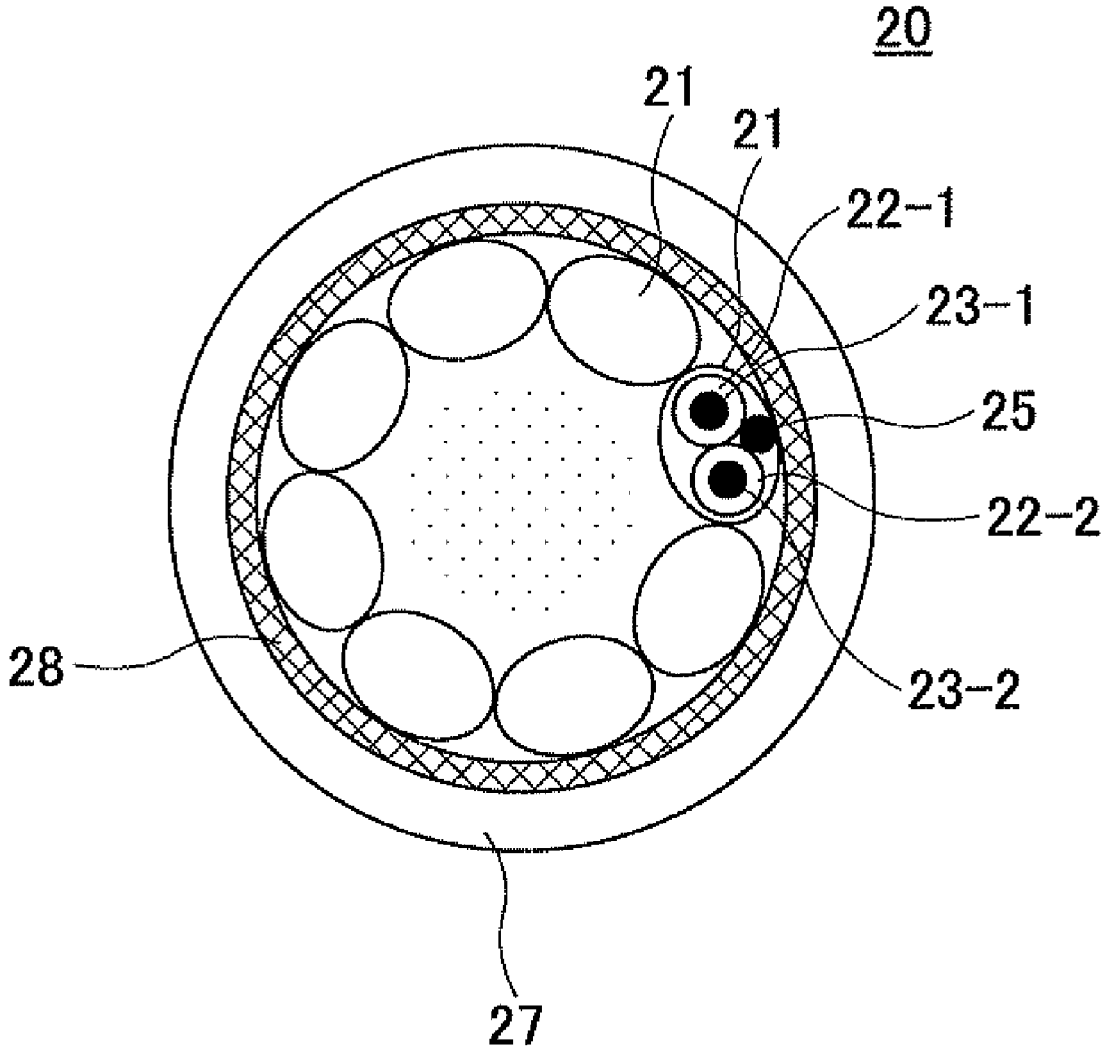
FIG.3 RELATED ART
FIG. 3 is a cross-sectional view of a balanced transmission cable 20.
Figure 4:
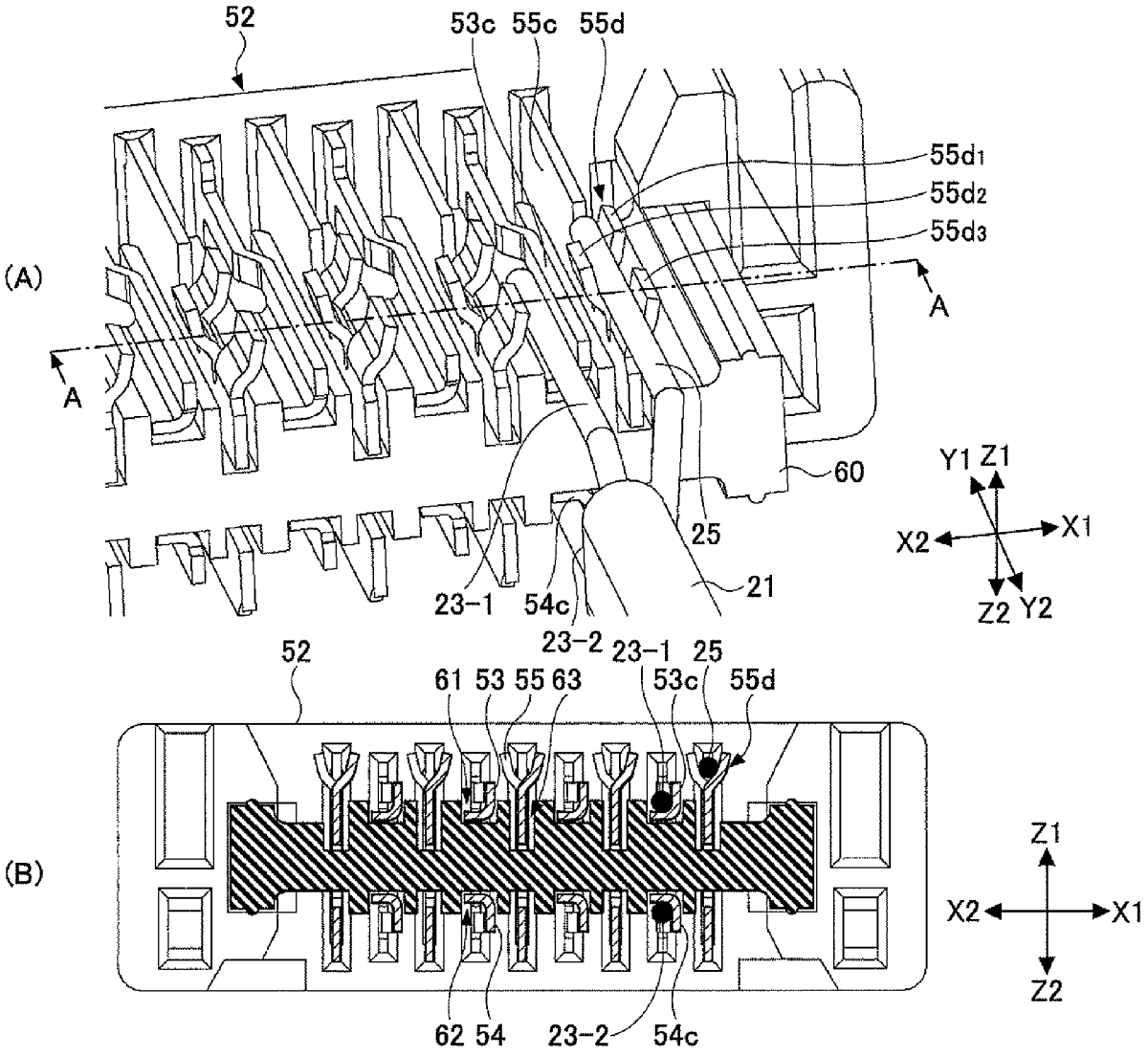
FIG. 4 is a view illustrating a connection part of an end of the balanced transmission cable 20 and a contact assembly body 51.
Figure 5:
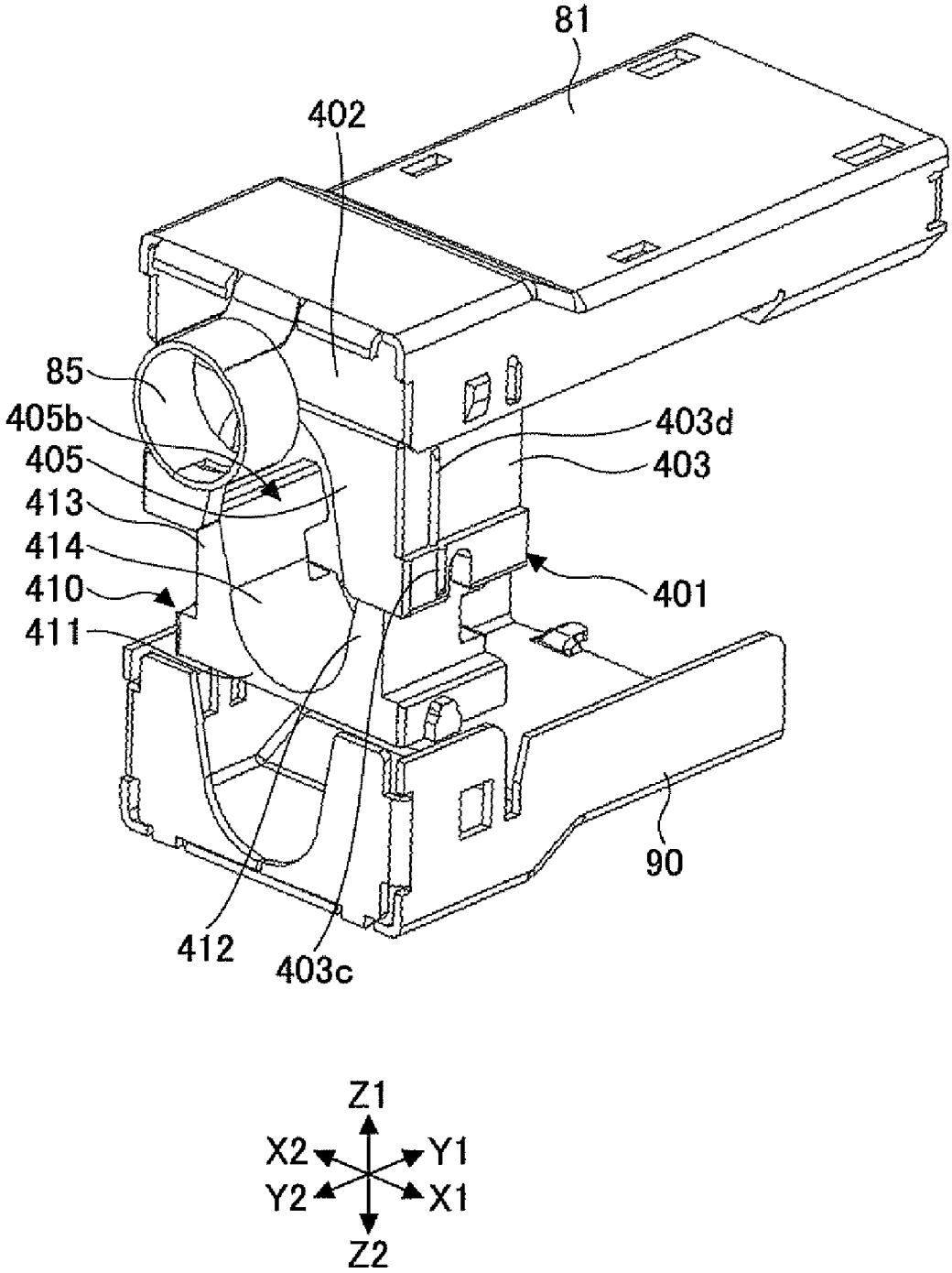
FIG.5 RELATED ART
FIG. 5 is an exploded perspective view of an inner cap 400 and a shield assembly body 80.
Figure 6:
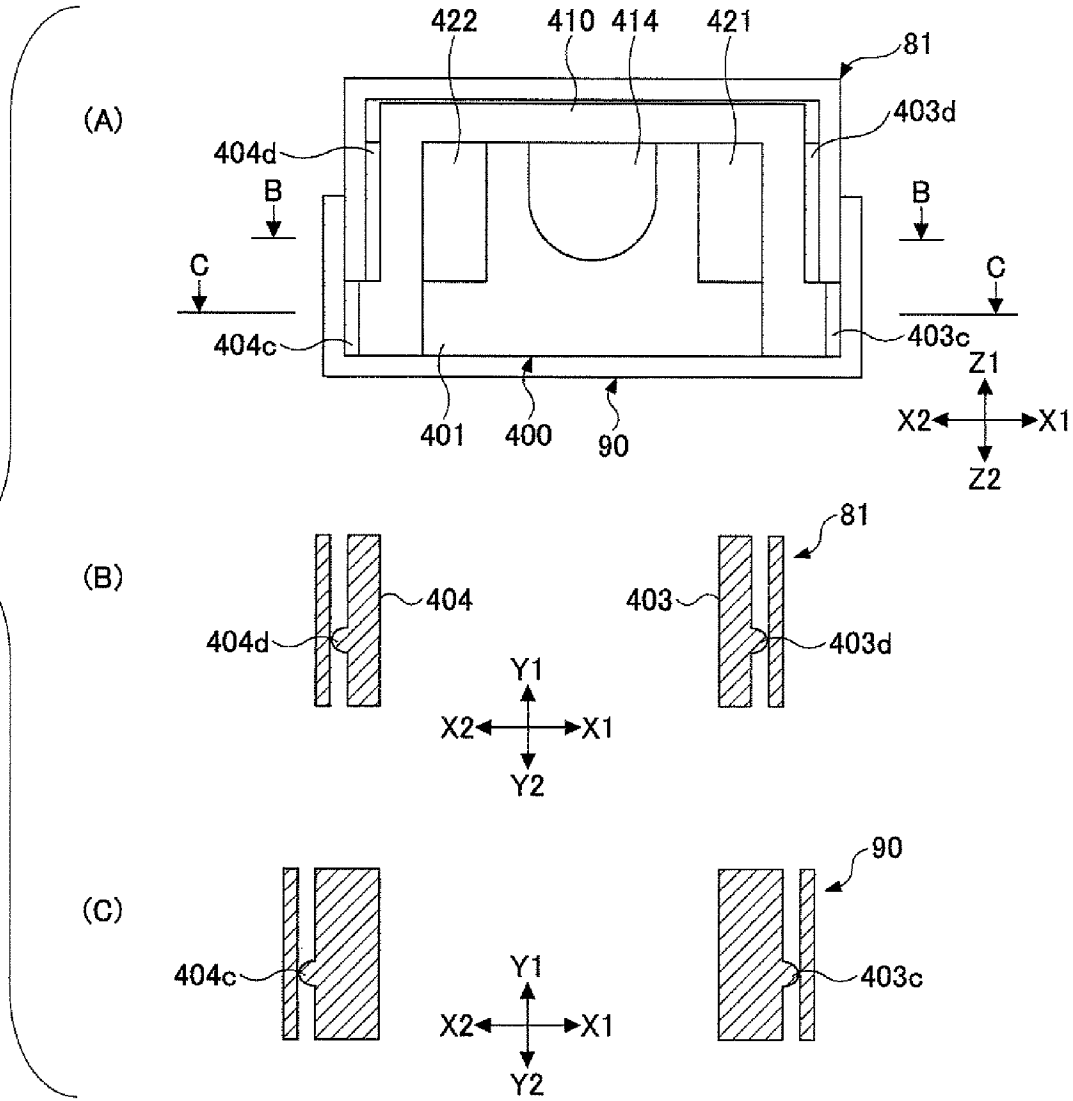
FIG. 6 is a view illustrating a gap between the inner cap 400 and the shield assembly body 80 that is closed.
Figure 7:
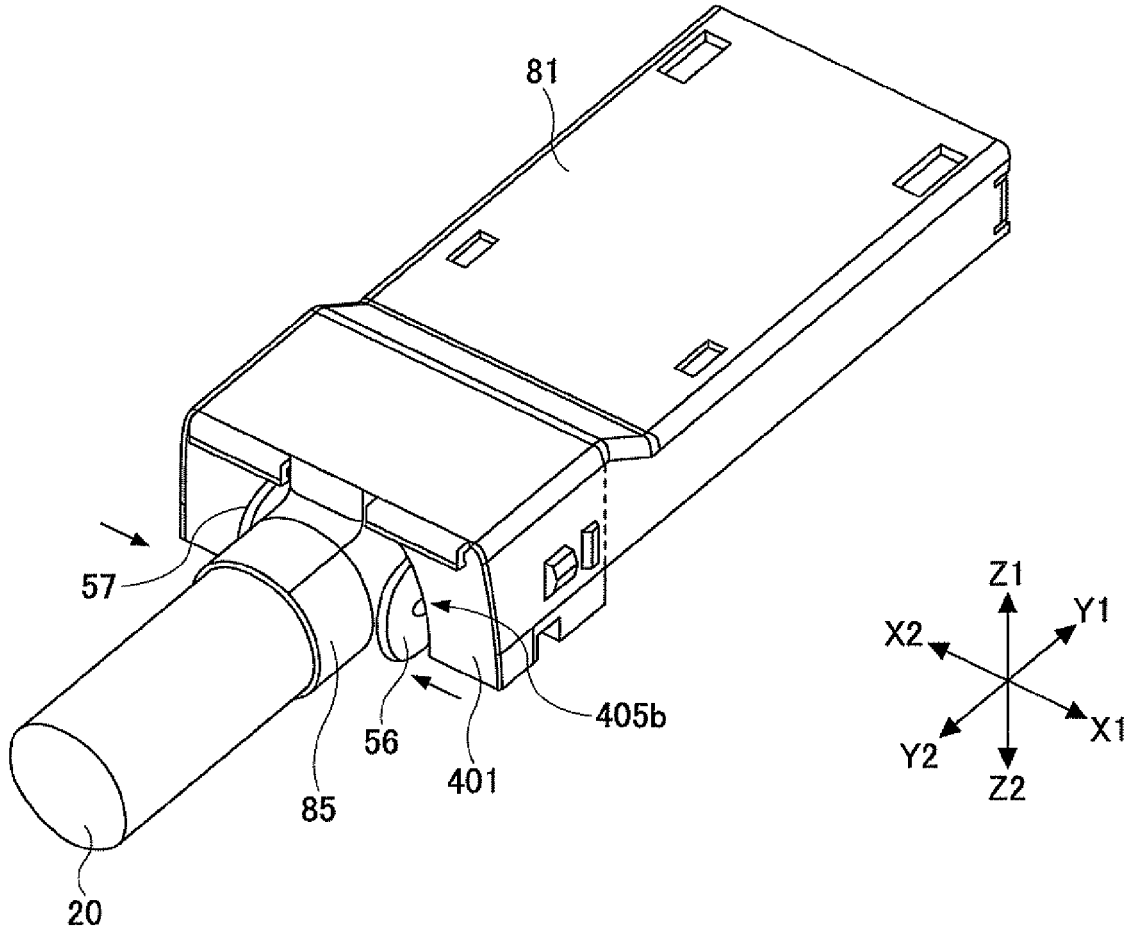
FIG.7 RELATED ART
FIG. 7 is a perspective view illustrating a part of the assembling process of the balanced transmission cable connector illustrated in FIG. 1.

A description is given below, with reference to the FIG. 8 through FIG. 22 of embodiments of the present invention.

In FIG. 3 through FIG. 22, "X1-X2" indicates a width direction, "Y1-Y2" indicates a longitudinal direction, and "Z1-Z2" indicates a height direction, of the balanced transmission cable connector. "Y1" is a rear surface (a side of a balanced transmission cable 20) direction. "Y2" is a front direction (inserting direction at the time of connection). In FIG. 8 through FIG. 22, parts that are the same as the parts shown in FIG. 1 through FIG. 7 are given the same reference numerals, and explanation thereof is omitted.

Figure 8:
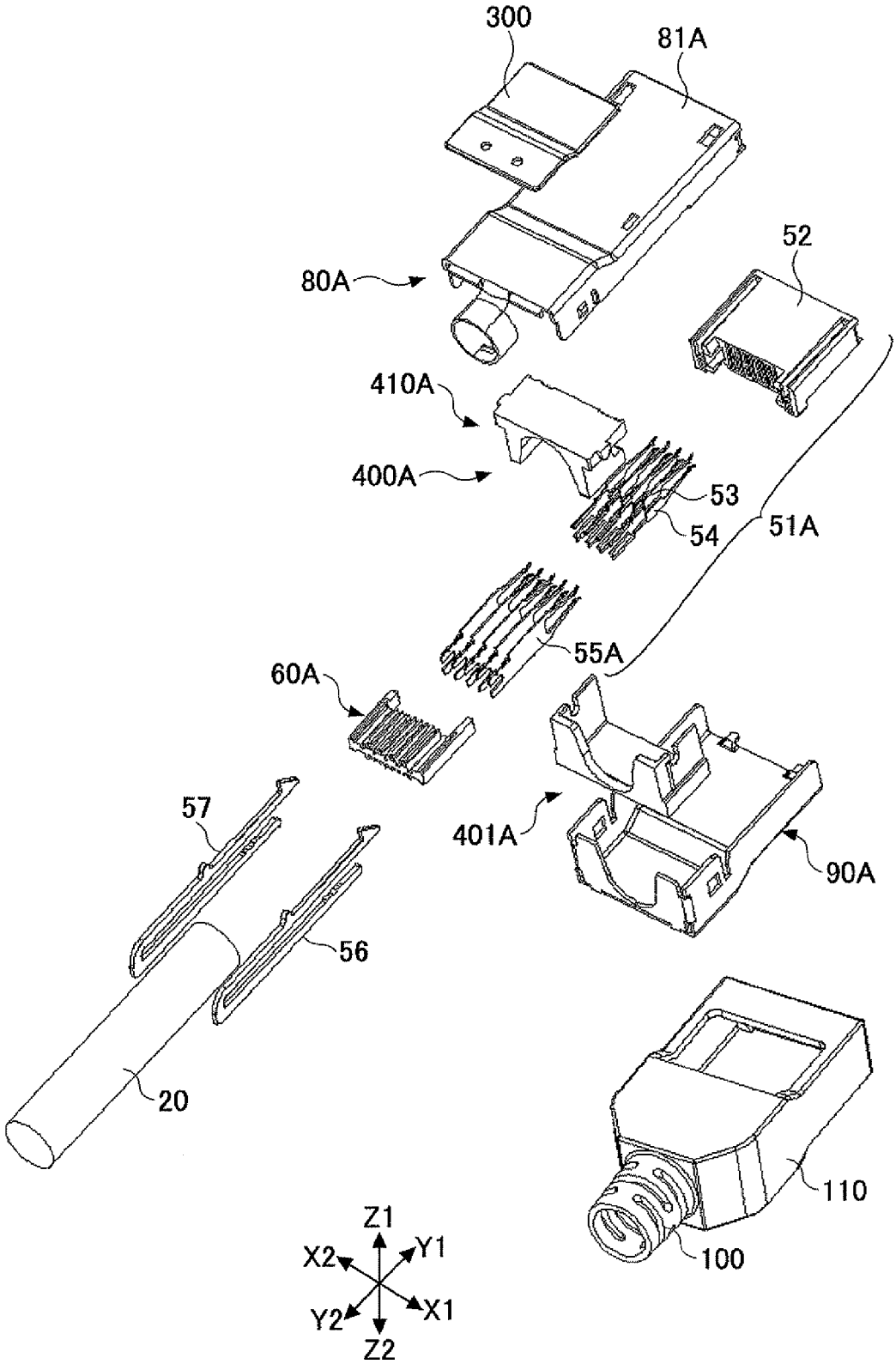
FIG. 8 is an exploded perspective view of a balanced transmission cable connector of an embodiment of the present invention.
Figure 9:
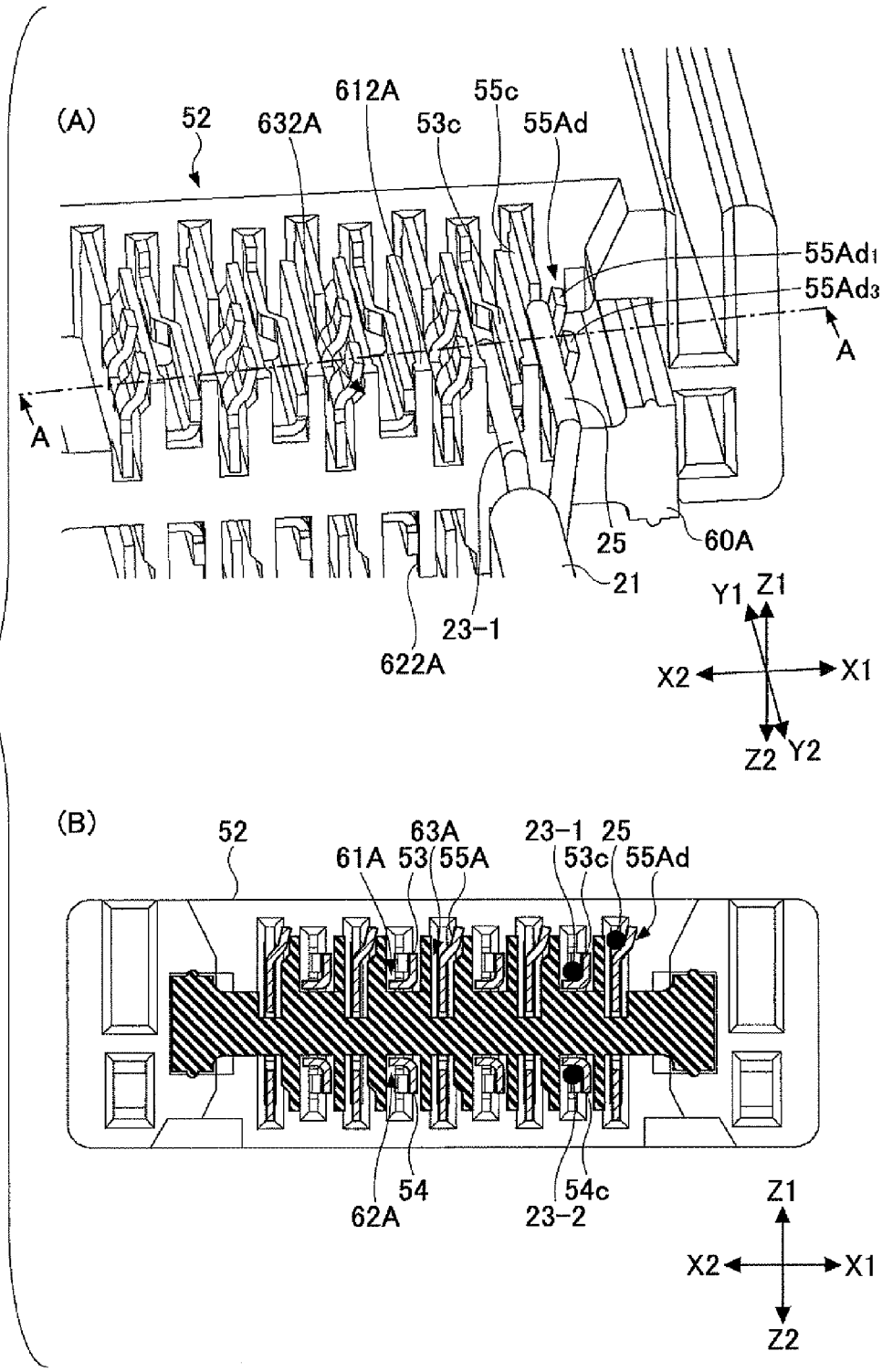
FIG. 9 is a view illustrating a connection part of the end of the balanced transmission cable connector 20 and a contact assembly body 51A.
Figure 10:
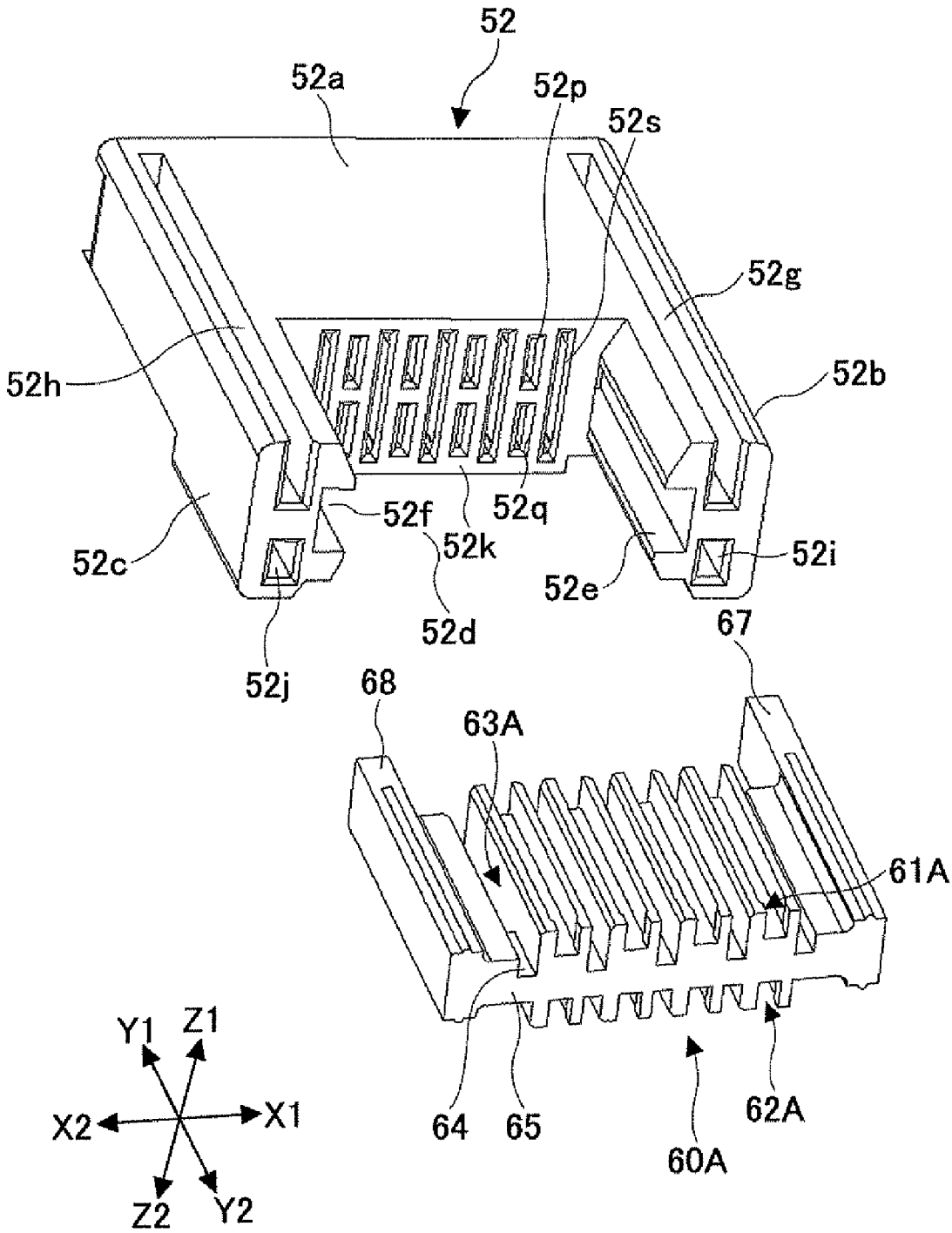
FIG. 10 is a perspective view where the contact assembly body 51A and a spacer 60A face each other.

FIG. 8 is an exploded perspective view of a balanced transmission cable connector of an embodiment of the present invention. FIG. 9 is a view illustrating a connection part of the end of the balanced transmission cable 20 and a contact assembly body 51A. FIG. 9(A) is a perspective view. FIG. 9(B) is a cross section taken along a line A-A of FIG. 9(B). FIG. 10 is a perspective view where the contact assembly body 51A and a spacer 60A face each other.

The balanced transmission cable connector is a device configured to electrically connect an electronic device such as an electronic computer, a server, an exchanger, or a computer. For example, the balanced transmission cable connector is used for connecting a digital copier to a peripheral device. The balanced transmission cable connector is inserted into and connected to a connector mounted on a circuit board in the digital copier. Although the cable connector of the embodiment of the present invention is a jack type, the cable connector may be a plug type. There is no limitation for kinds of the cable connector.

The balanced transmission cable connector includes, as illustrated in FIG. 8, a balanced transmission cable 20, a contact assembly body 51A, a pair of lock arms 56 and 57, a spacer 60A, a shield cover assembly body 80A, a hood 100, an outer cover 110 and an inner cap 400A. The structure of each component is discussed below.

[Contact Assembly Body 51A]

The contact assembly body 51A has a structure illustrated in FIG. 8 and FIG. 9. That is, in an insulative block body 52, first and second signal contacts 53 and 54 and a ground contact 55A are alternately arranged in a row direction (X1-X2 direction). The first signal contact 53 and the second signal contact 54 face each other in a line direction (Z1-Z2 direction).

In addition, a pair of the lock arms 56 and 57 is provided one lock arm at each end in the X direction. The first signal contact 53 is positioned at a Z1 side and the second signal contact 54 is positioned at a Z2 side, of the same position in the X direction.

The insulative block body 52 includes, as illustrated in FIG. 10, a rectangular parallelepiped part 52*a* and a pair of arm parts 52*b* and 52*c*. In the rectangular parallelepiped part 52*a*, a large number of holes 52*p*, 52*q* and 52*s* where the contacts are inserted are regularly formed. The pair of arm parts 52*b* and 52*c* extends from the rectangular parallelepiped part 52*a* in the Y2 direction.

A space part 52*d* is formed between the arm parts 52*b* and 52*c*. Guide grooves 52*e* and 5*f* are formed inside of the arm parts 52*b* and 52*c*, respectively, facing each other. In addition, the grooves 52*g* and 52*h* and holes 52*i* and 52*j* are formed at head end surfaces (Y2 side surfaces) of the arm parts 52*b* and 52*c*, respectively.

Figure 11:
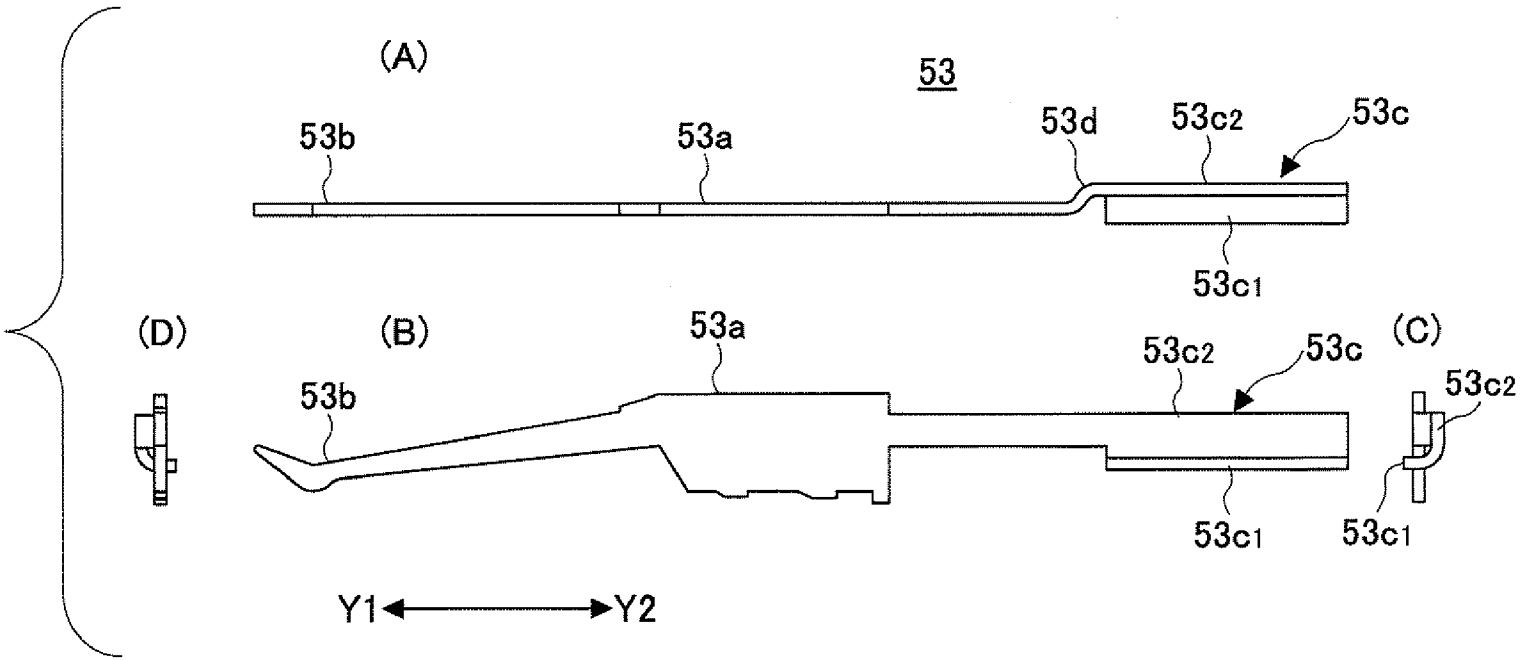
FIG. 11 is a view illustrating a first signal contact 53.

FIG. 11 is a view illustrating the first signal contact 53. The first signal contact 53 has a plate-shaped configuration. The first signal contact 53 includes a center part 53*a*, a Y1 side contact part 53*b*, and a Y2 side first signal wire connecting part 53*c*. The center part 53*a* includes a bulge part.

The first signal wire connecting part 53*c* has an L-shaped cross section. The first signal wire connecting part 53*c* includes a horizontal plate part 53*c*1 and a side plate part 53*c*2. The side plate part 53*c*2 is situated in parallel with the center part 53*a*.

Furthermore, a crank bending part 53*d* is provided between the side plate part 53*c*2 and the center part 53*a*. The side plate part 53*c*2 is slightly shifted in a direction (X1 direction) perpendicular to the center part 53*a*.

Figure 12:
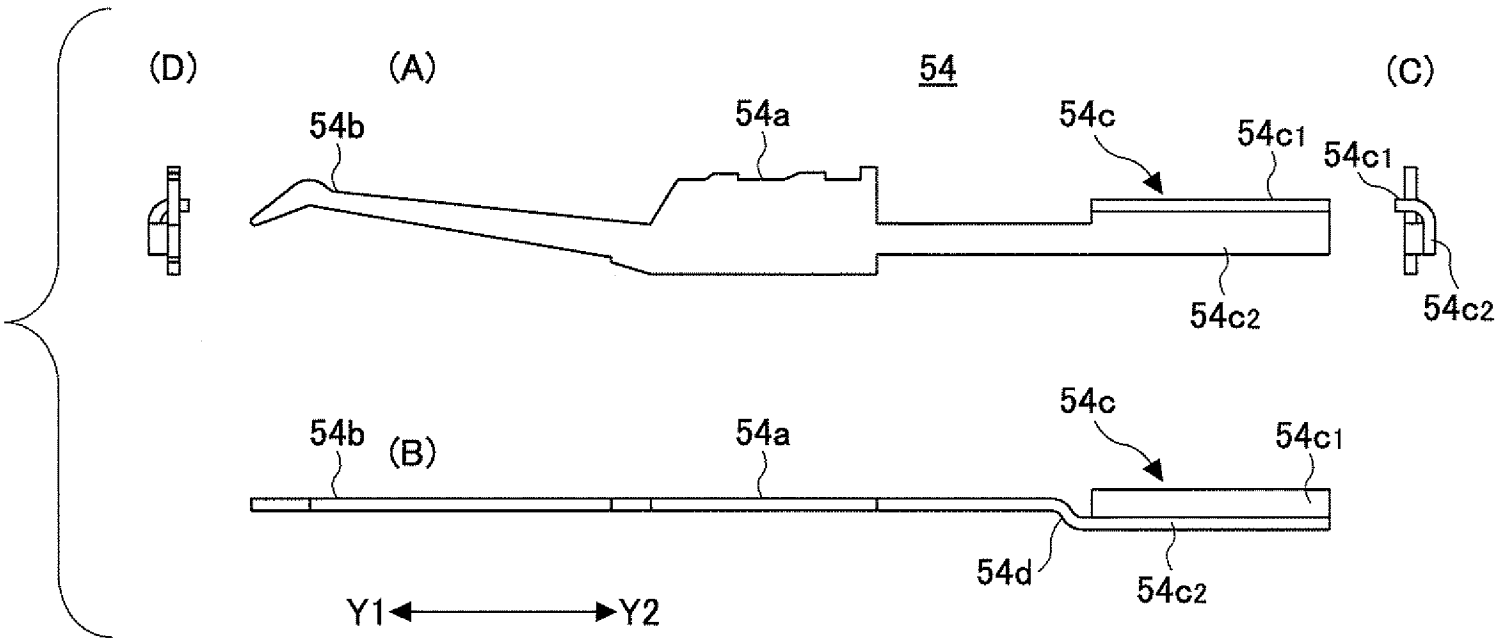
FIG. 12 is a view illustrating a second signal contact 54.

FIG. 12 is a view illustrating the second signal contact 54. The second signal contact 54 has a plate-shaped configuration. The second signal contact 54 includes a center part 54*a*, a Y1 side contact part 54*b*, and a Y2 side second signal wire connecting part 54*c*. The center part 54*a* includes a bulge part.

The second signal wire connecting part 54*c* has an L-shaped cross section. The second signal wire connecting part 54*c* includes a horizontal plate part 54*c*1 and a side plate part 54*c*2. The side plate part 54*c*2 is situated in parallel with the center part 54*a*.

Furthermore, a crank bending part 54*d* is provided between the side plate part 54*c*2 and the center part 54*a*. The side plate part 54*c*2 is slightly shifted in a direction (X1 direction) perpendicular to the center part 54*a*.

Each of plural of the first and second signal contacts 53 and 54 is press-fitted into plural holes 52*p* and 52*q*, respectively, (see FIG. 10) of the block body 52 from the Y2 side.

Figure 13:
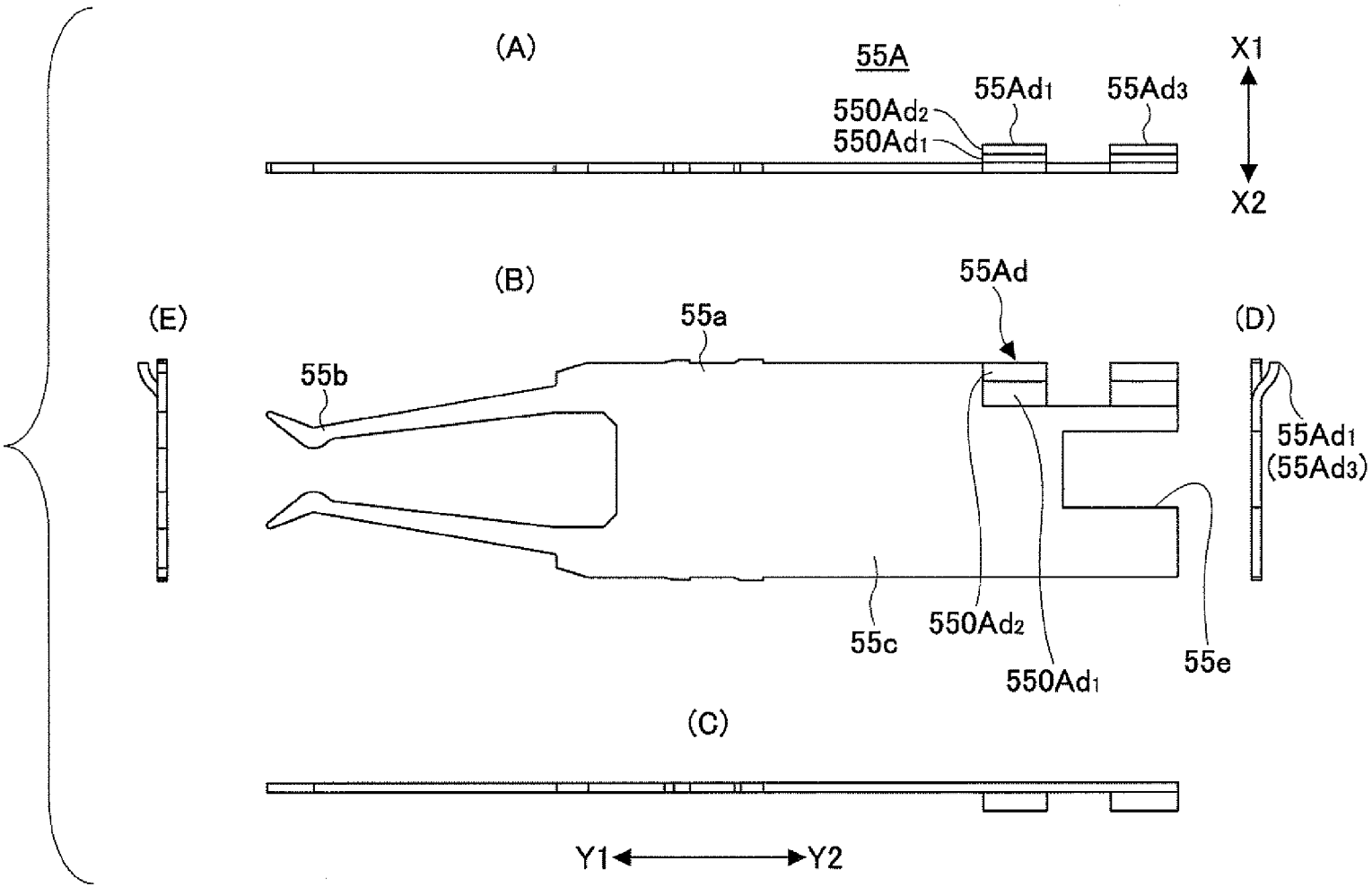
FIG. 13 is a view illustrating a ground contact 55A.

FIG. 13 is a view illustrating the ground contact 55A. The ground contact 55A has a plate-shaped configuration. The ground contacts 55A are provided, one by one, between the paired signal contacts 53 and 54 neighboring each other in the X direction, and thereby cross-talk is prevented between signals. The ground contact 55A includes a center part 55*a*, a Y1 side contact part 55*b*, a Y2 side plate-shaped part 55*c*, a drain wire connecting part 55Ad, and a notch part 55*e*. The center part 55*a* includes a bulge part. The contact part 55*b* has a fluke-shaped configuration. The notch part 55*e* is provided at the end of the Y2 side.

The drain wire connecting part 55Ad includes two lugs 55Ad1 and 55Ad3 situated at a Z1 end edge of the ground contact 55A. Each of the lugs 55Ad1 and 55Ad3 has an L-shaped cross section. Each of the lugs 55Ad1 and 55Ad3 has an inclination plate part 550Ad1 and a side plate part 550Ad2. The inclination plate part 550Ad1 obliquely projects from the plate-shaped part 55*c* in the X1 direction. The side plate part 550Ad2 is situated in parallel with the plate-shaped part 55*c*.

Plural of the ground contacts 55A are press fitted into the corresponding plural holes 52*s* (see FIG. 10) of the block body 52 from the Y2 side.

As illustrated in FIG. 9, where the plural first and second signal contacts 53 and 54 and the ground contacts 55A are provided in the block body 52, the first and second signal wire connecting parts 53*c* and 54*c* facing in the line direction, the plate-shaped parts 55*c*, and the drain wire connecting parts 55Ad are alternately arranged in a row direction within the space part 52*d*.

[A Pair of the Lock Arms 56 and 57]

Figure 14:
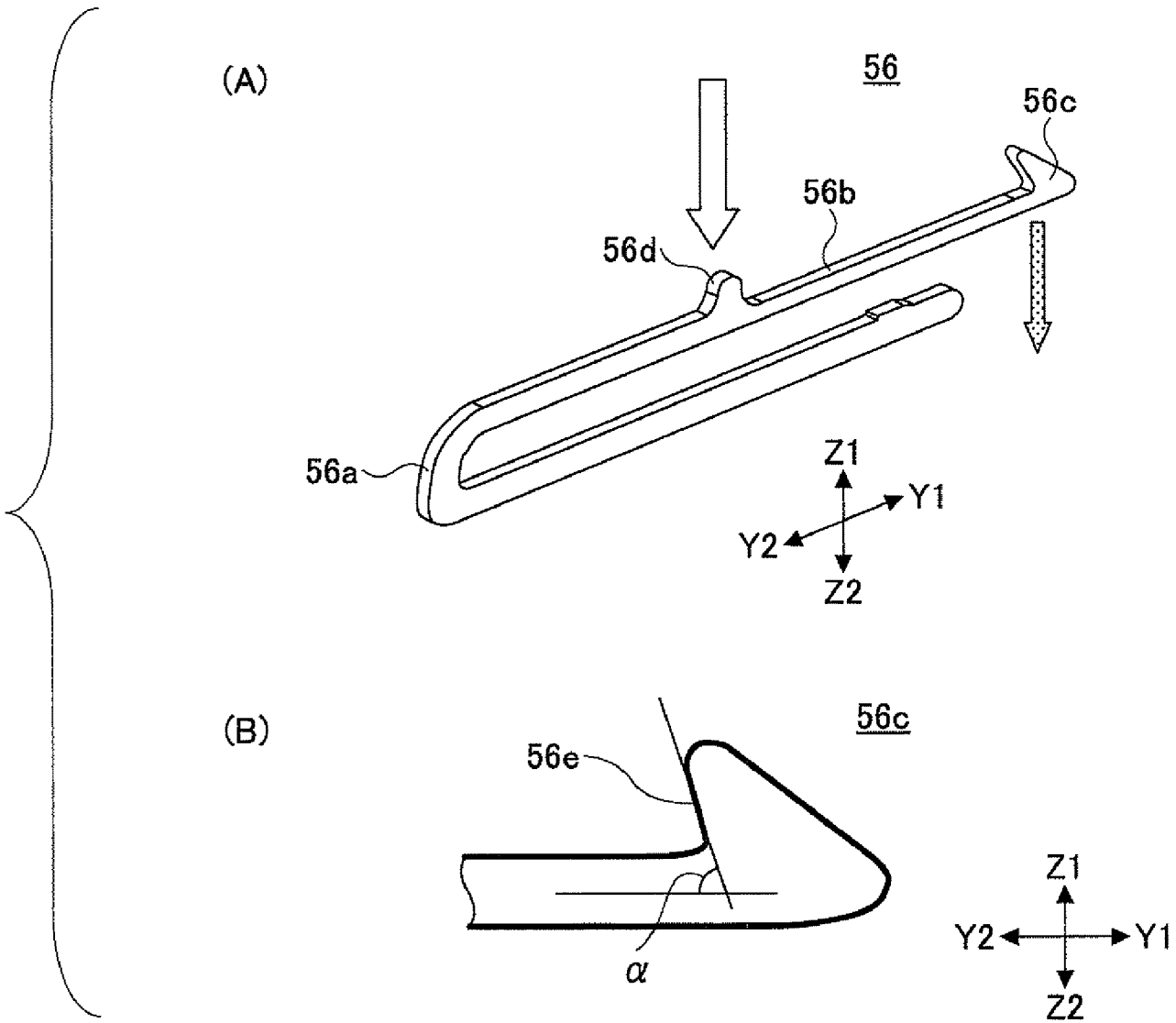
FIG. 14 is a view illustrating a lock arm 56.

FIG. 14 is a view illustrating the lock arm 56. As illustrated in FIG. 8 and FIG. 14, the lock arm 56 includes a U-shaped configuration part 56*a*, an arm part 56*b*, a hook part 56*c*, and a projection part 56*d*. The U-shaped configuration part is provided at the Y2 side. The arm part 56*b* extends from a Z1 side part of the U-shaped configuration part 56*a* in the Y1 direction. The hook part 56*c* is provided at the head end of the arm part 56*b*. The projection part 56*d* is provided at a Y2 side part of the arm part 56*b*.

The lock arm 56 is arranged to contact the block body 52 where an end of the U-shaped configuration part 56*a* is inserted in and fixed to the hole 52*i* and the arm part 56*b* is loosely fitted to the groove 52*g*. The lock arm 57 having the same configuration as that of the lock arm 56 is arranged to contact the block body 52 in the same way as the lock arm 56.

As illustrated in FIG. 14(B), the hook part 56*c* has a configuration where a Y2 side edge 56*e* has an acute angle $\alpha$ with the Y axial line. In other words, the edge 56*e* to be engaged inclines in a direction opposite to a side of the head end of the balanced transmission cable connector.

The balanced transmission cable connector is connected to a connector of a device side. The hook part 56*c* is engaged with a slit of the connector of the device side so that a locking state is formed. Since the angle $\alpha$ is an acute angle, there is a holding force of the locking state when the balanced transmission cable connector is connected to the connector of the opponent device side.

[Spacer 60A]

The spacer 60A is positioned at a rear surface side (Y2 side) of the contact assembly body 51A so that plural wire connecting parts 53*c*, 54*c*, and 55Ad are positioned. The spacer 60A is made of an insulative plate member. As illustrated in FIG. 10, the spacer 60A includes plural first groove parts 61A, plural second groove parts 62A, plural slits 63A, and projecting arm parts 67 and 68.

The first groove part 61A has a configuration corresponding to the first signal wire connecting part 53*c*. As illustrated in FIG. 10, the first groove part 61A is formed in a Z1 side surface of the spacer 60A. The first groove part 61A pierces the spacer 60A in the Y1-Y2 direction. A pair of projection parts 612A (see FIG. 9(A)) is provided at the rear surface side (Y2 side) of the first groove part 61A so as to sandwich the head end of the first signal wire connecting part 53*c*.

The dimension of the width direction (X1-X2 direction) of the first groove part 61A is slightly greater than the dimension of the width direction (X1-X2 direction) of the first signal wire connecting part 53*c*. The dimension of the depth direction (Z1-Z2 direction) of the first groove part 61A is sufficiently greater than the dimension of the depth direction (Z1-Z2 direction) of the first signal wire connecting part 53*c*.

The second groove part 62A has a configuration corresponding to the second signal wire connecting part 54*c*. As illustrated in FIG. 10, the second groove part 62A is formed in a Z2 side surface of the spacer 60A. The second groove part 62A pierces the spacer 60A in the Y1-Y2 direction. A pair of projection parts 622A (see FIG. 9(A)) is provided at the rear surface side (Y2 side) of the second groove part 62A so as to sandwich the head end of the second signal wire connecting part 54*c*.

The dimension of the width direction (X1-X2 direction) of the second groove part 62A is slightly greater than the dimension of the width direction (X1-X2 direction) of the second signal wire connecting part 54*c*. The dimension of the depth direction (Z1-Z2 direction) of the second groove part 62A is sufficiently greater than the dimension of the depth direction (Z1-Z2 direction) of the second signal wire connecting part 54*c*.

The first groove part 61A and the second groove part 62A having the same dimensions and configurations are situated in the same positions in the row direction (X1-X2 direction).

The slit 63A has a configuration corresponding to the plate-shaped part 55*c* of the ground contact 55A. As illustrated in FIG. 10, the slit 63A is provided so as to cut between neighboring groove parts 61A and neighboring groove parts 62A from the Y1 side. A concave part 632A (see FIG. 9(A)) is formed at a side surface of the slit 63A. The concave part 632A corresponds to the drain wire connecting part 55Ad of the ground contact 55A.

A non-slit part 64 has a size corresponding to the notch part 55*e* of the ground contact 55A. The non-slit part 64 is provided between an end of the slit 63A and a surface 65 at the Y2 side of the spacer 60A.

Next, arrangement of the contact assembly body 51A and the spacer 60A is discussed.

The spacer 60A is provided to the block body 52 of the contact assembly body 51A, by guiding, inserting and engaging the arm parts 67 and 68 to and with the guide grooves 52*e* and 5*f* in the Y1 direction. At this time, the first signal contact 53, the second signal contact 54, and the ground contact 55A are provided in the block body 52. In addition, at this time, the first signal wire connecting part 53*c*, the second signal wire connecting part 54*c*, the plate-shaped part 55*c*, and the drain wire connecting part 55Ad are arranged and project into the space part 52*d*.

At this time, the first signal wire connecting part 53*c* and the second signal wire connecting part 54*c* are inserted into the first groove part 61A and the second groove part 62A from the Y1 side in the Y2 direction, so as to be sandwiched by pairs of the projection parts 612A and 622A, respectively. Because of this, it is possible to reduce an inserting resistance of the first and second signal wire connecting parts 53*c* and 54*c* against the first and second groove parts 61A and 62A. In addition, it is possible to securely position the first and second signal wire connecting parts 53*c* and 54*c*.

As illustrated in FIG. 9, the first signal wire connecting part 53*c* is engaged with the first groove part 61A so that the position of the first signal wire connecting part 53*c* in the X1-X2 direction and Z2 direction is controlled. In addition, the second signal wire connecting part 54*c* is engaged with the second groove part 62A so that the position of the second signal wire connecting part 54*c* in the X1-X2 direction and Z1 direction is controlled.

Furthermore, with respect a part of the ground contact 55A projecting into the space part 52*d*, the plate-shaped part 55*c* and the drain wire connecting part 55Ad are engaged with the slit 63A. The notch part 55*e* is engaged with the non-slit part 64. The position of the drain wire connecting part 55Ad in the X1-X2 direction and the Z1-Z2 direction is controlled.

Under this structure, it is possible to prevent the contact of the plate-shaped part 55*c* and the drain wire connecting part 55Ad and the signal wire connecting parts 53*c* and 54*c*.

[Connection of the Pair Electric Wire 21]

As illustrated in FIG. 9(A), the insulative covering signal electric wires 22-1 and 22-2 and the drain wire 25 extend from ends of each of the pair electric wires 21 to the outside. The head ends of the insulative covering signal electric wires 22-1 and 22-2 are processed so that the first signal wire 23-1 and the second signal wire 23-2 are exposed. The first signal wire 23-1 and the second signal wire 23-2 form a pair of electric wires.

The first signal wire 23-1 is connected to, by soldering, the first signal wire connecting part 53*c*. The first signal wire connecting part 53*c* is engaged with the inside of the first groove part 61A. In addition, the second signal wire 23-2 is connected to, by soldering, the second signal wire connecting part 54*c*. The position of the second signal wire connecting part 54*c* is controlled by the second groove part 62A.

The drain wire 25 is connected to, by soldering, the drain wire connecting part 55Ad. The position of the drain wire connecting part 55Ad is controlled by the slit 63A.

As illustrated in FIG. 9(B), side plate parts 53*c*2 and 54*c*2 of the first and second signal wire connecting parts 53*c* and 54*c* face corresponding side surfaces of the first and second groove parts 61A and 62A with separation. Because of this, the first and second signal wires 23-1 and 23-2 are arranged and positioned between the side plate parts 53*c*2 and 54*c*2 of the first and second signal wire connecting parts 53*c* and 54*c* and the side surfaces of the first and second groove parts 61A and 62A, respectively, so as to be fixed by soldering.

In addition, the side plate part 550Ad2 of the drain wire connecting part 55Ad faces the side surface of the slit 63A with separation. Because of this, the drain wire 25 is arranged and positioned between the side plate part 550Ad2 of the drain wire connecting part 55Ad and the side surface of the slit 63A so as to be fixed by soldering.

Thus, since the first and second signal wires 23-1 and 23-2 are received in the groove parts 61A and 62A, it is possible to prevent the signal wires 23-1 and 23-2 and the drain wire 25 from being fixed by soldering in error. Hence, it is possible to improve soldering operations.

In addition, since the first and second signal wire connecting parts 53*c* and 54*c* are received in the groove parts 61A and 62A, it is possible to provide a resin layer having a high dielectric constant instead of an air layer in the periphery of the first and second signal wire connecting parts 53*c* and 54*c*. Accordingly, it is possible to reduce characteristic impedance.

Furthermore, as illustrated in FIG. 9(B), the side plate part 53*c*2 is slightly shifted in the X1 direction compared to the center part 53*a* by the crank bending part 53*d*. Therefore, the first signal wire 23-1 fixed by solder is arranged coaxially with the contact part 53*b*. In other words, the center line of the first signal wire 23-1 fixed by solder is consistent with the center part of the contact part 53*b*.

Similarly, the side plate part 54*c*2 is slightly shifted in the X1 direction compared to the center part 54*a* by the crank bending part 54*d*. Therefore, the second signal wire 23-2 fixed by solder is arranged coaxially with the contact part 54*b*. In other words, the center line of the second signal wire 23-2 fixed by solder is consistent with the center part of the contact part 54*b*.

[Shield Assembly Body 80A]

Figure 15:
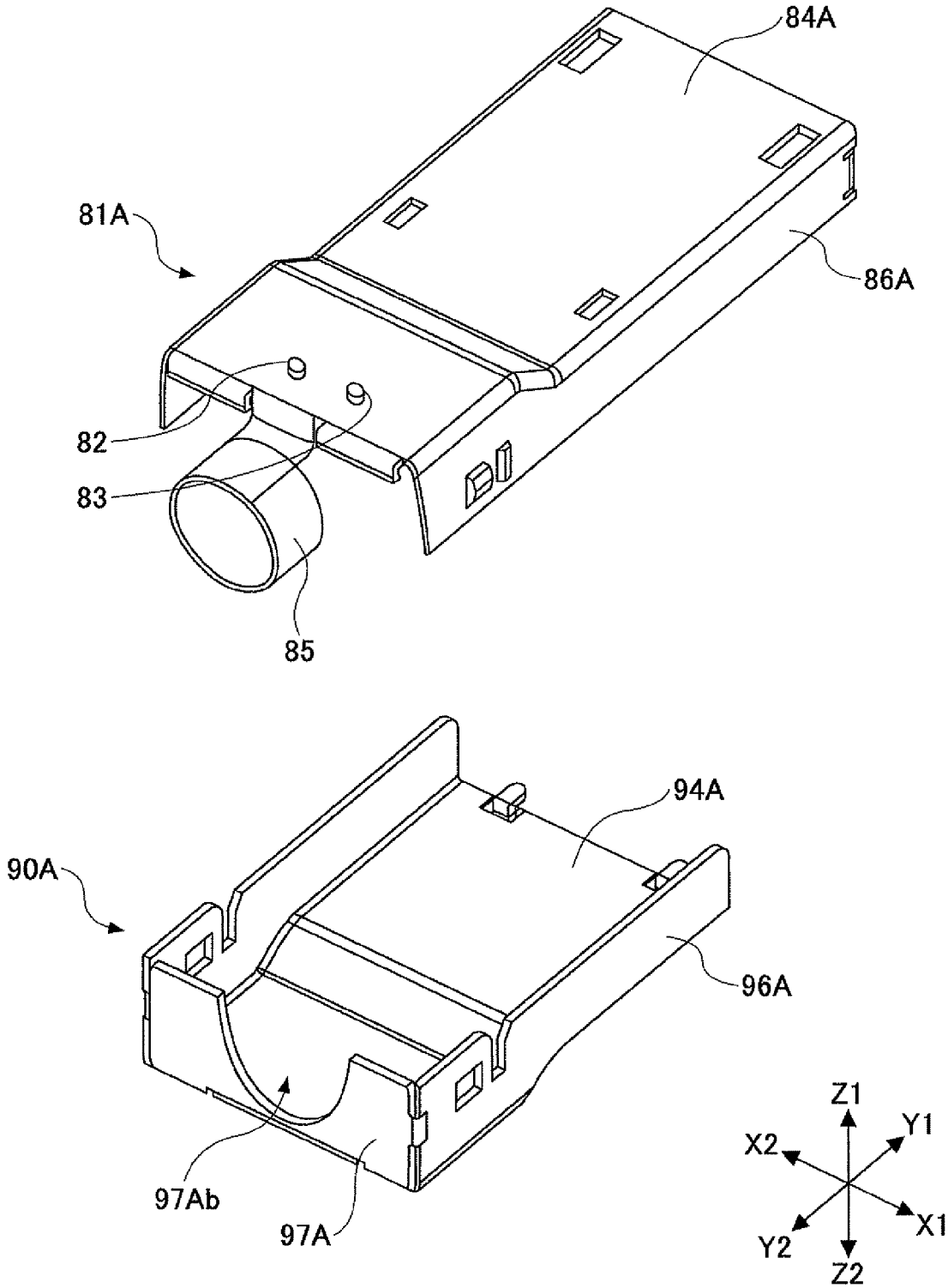
FIG. 15 is an exploded view of a shield cover assembly body 80A.

FIG. 15 is an exploded view of the shield cover assembly body 80A. The shield cover assembly body 80A includes a first shield cover 81A at the Z1 side and a second shield cover 90A at the Z2 side. The first shield cover 81A and the second shield cover 90A are, for example, metal plate pressed components. The first shield cover 81A and the second shield cover 90A are combined so as to surround the contact assembly body 51A, the pair of the lock arms 56 and 57, and the spacer 60A.

The first shield cover 81A includes a top plate part 84A at the Z1 side, a pair of side plate parts 86A one at each side (X1 side and X2 side), and a ring part 85 at the rear surface side (Y2 side). The ring part 85 is configured to clamp the balanced transmission cable 20.

Plural piercing holes are formed in the top plate part 84A. As illustrated in FIG. 16*r* hook parts 56*c* and 57*c* of the lock arms 56 and 57 and the projection parts 56*d* and 57*d* project through the corresponding plural piercing holes. Projection parts 82 and 83 are formed in the top plate part 84A so as to project in the Z1 direction.

The second shield cover 90A includes a bottom board part 94A at the Z2 side, a pair of side plate parts 96A one at each side (X1 side and X2 side), and a rear plate part 97A at the rear surface side (Y2 side).

The bottom plate part 94A faces the top plate part 84A with separation. The side plate parts 96A and the corresponding side plate parts 86A are engaged with each other so as to form side walls of the shield cover assembly body 80A. A window part 97Ab having a substantially semicircular-shaped configuration is formed in the rear plate part 97A. The balanced transmission cable 20 is inserted in the window part 97A*b*.

[Hood 100 and Outer Cover 110]

The hood 100 covers the ring part 85 and reinforces the balanced transmission cable 20. The outer cover 110 covers the shield cover assembly 80A. The hood 100 and the outer cover 110 are formed by outsert molding the shield cover assembly body 80A.

Figure 16:
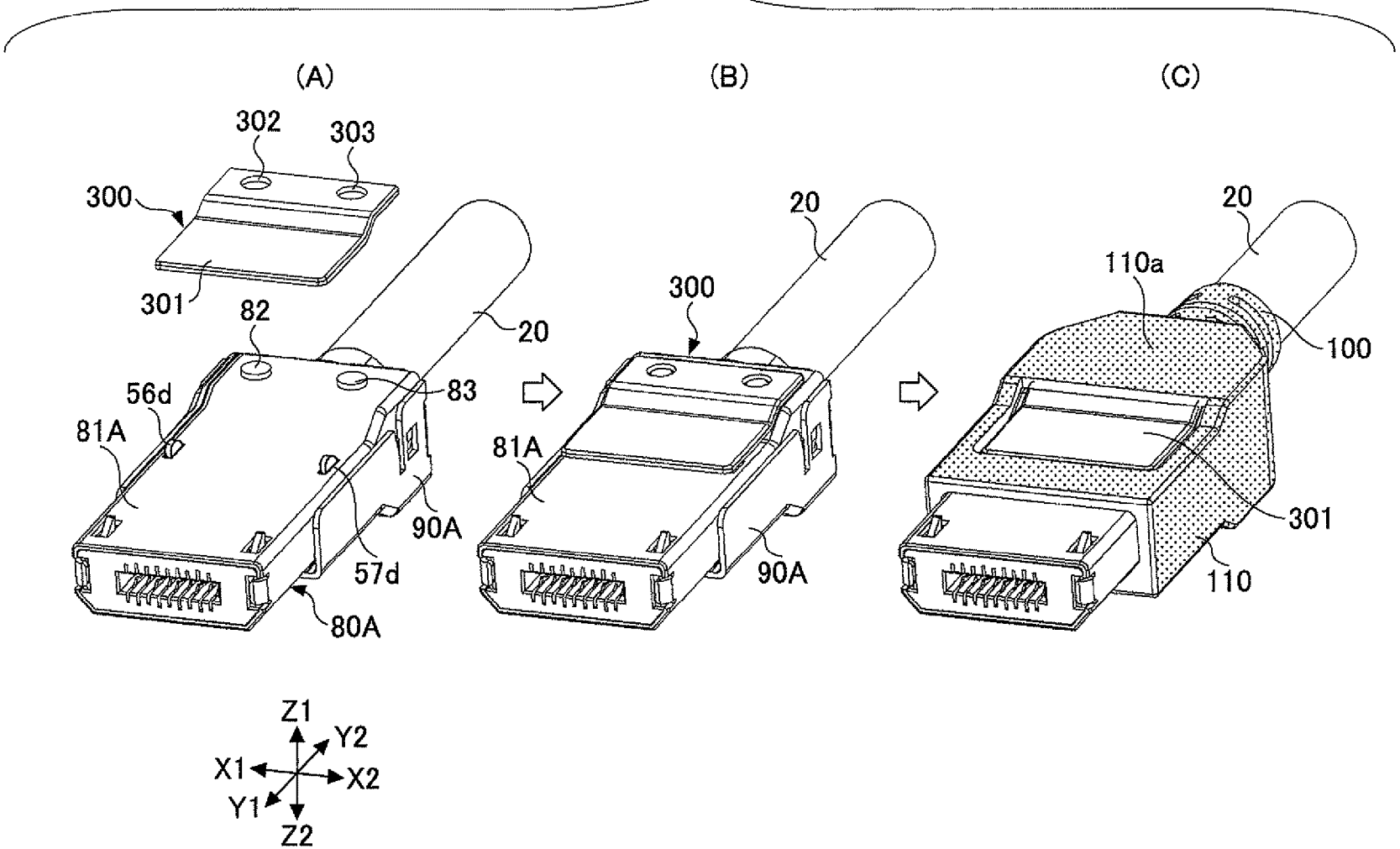
FIG. 16 is a perspective view of outsert molding a hood 100 and an outer cover 110.

Next, a process of the outsert molding is discussed with reference to FIG. 16. FIG. 16 is a perspective view of outsert molding the hood 100 and the outer cover 110.

First, as illustrated in FIG. 16(A) and FIG. 16(B), openings 302 and 303 of an operating member 300 are engaged with projection parts 82 and 83 so that the operating member 300 is positioned. The operating member 300 is set on the shield cover assembly body 80A so as to cover projection parts 56*d* and 57*d*.

Next, this structure is set in the mold so that the outsert molding is performed. By outsert molding, as illustrated in FIG. 16(C), the hood 100 and the outer cover 110 are formed in a body. The outer cover 110 is formed so as to cover the shield cover assembly body 80A and the hood 100 is formed so as to cover the ring part 85.

Figure 17:
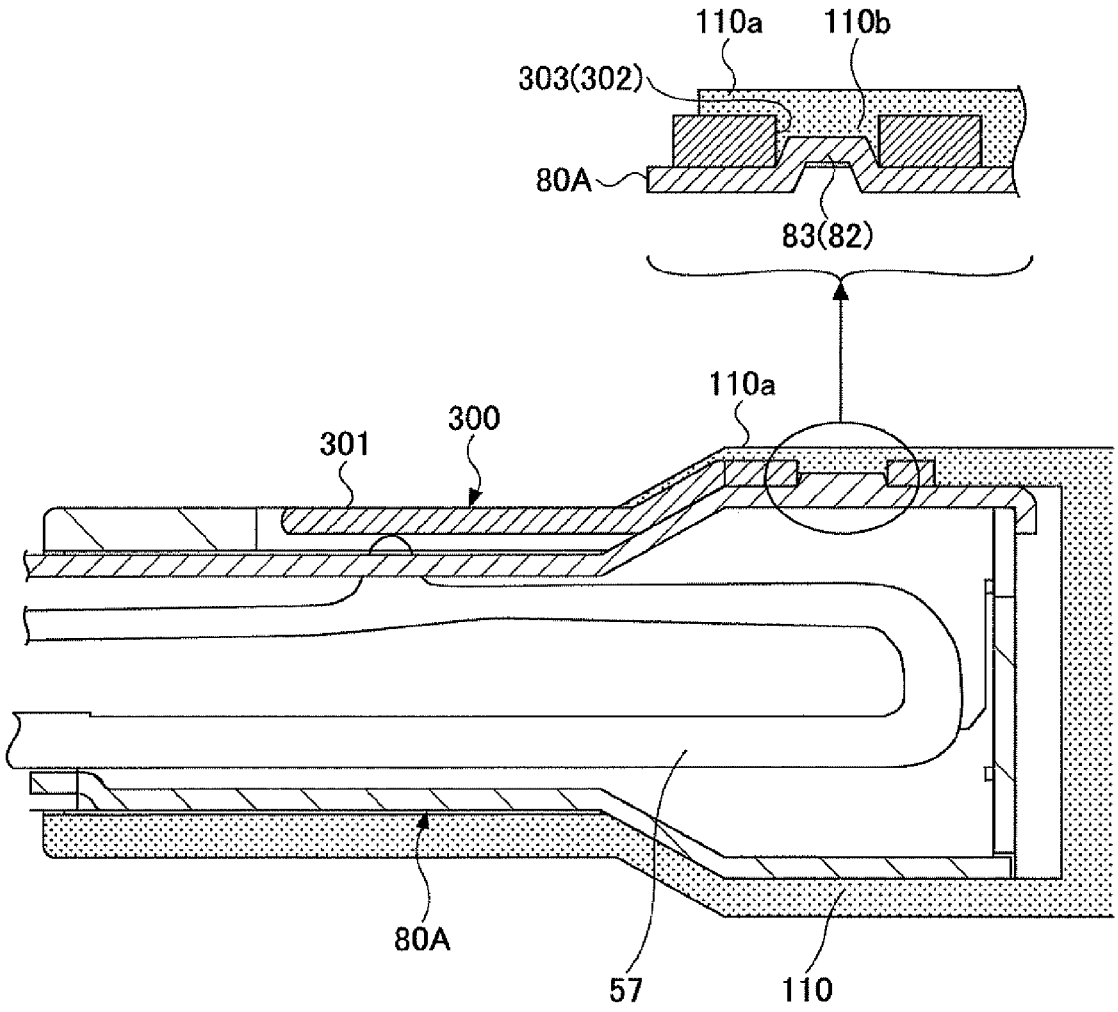
FIG. 17 is a cross-sectional view of the balanced transmission cable connector taken in a position of a lock arm 57.

In the outsert molding, an upper surface of the operating part 301 of the operating member 300 and a part along an edge of the operating part 3-1 are not covered with resin. FIG. 17 is a cross-sectional view of the balanced transmission cable connector taken in a position of the lock arm 57. In FIG. 17, a part of the outer cover 110 indicated by a numerical reference 110*a* covers a Y2 side part of the operating member 300. In addition, inside of openings 302 and 303 is embedded by a part indicated by a numerical reference 110*b*. The operating member 300 is fixed on the shield cover assembly body 80A by the resin parts 110*a* and 110*b*.

The operating member 300 includes the operating part 301 situated at the Y1 side. The operating part 301 is positioned right on the projection parts 56*d* and 57*d* of the pair of the lock arms 56 and 57. When the operating part 301 is pushed, the arm parts 56*b* and 57*b* are bent so that the hook parts 56*c* and 57*c* go down. As a result of this, the locking state of the balanced transmission cable connector and an opponent connector is turned off.

The shield cover assembly body 80A includes the window part 97Ab situated at the Y2 side where the balanced transmission cable 20 is inserted. Therefore, at the time of outsert molding, the resin may flow from the Y2 side to the inside of the shield cover assembly body 80A. Because of this, as discussed below, the inner cap 400A is provided at the Y2 side of the inside of the shield cover assembly body 80A.

[Inner Cap 400A]

Figure 18:
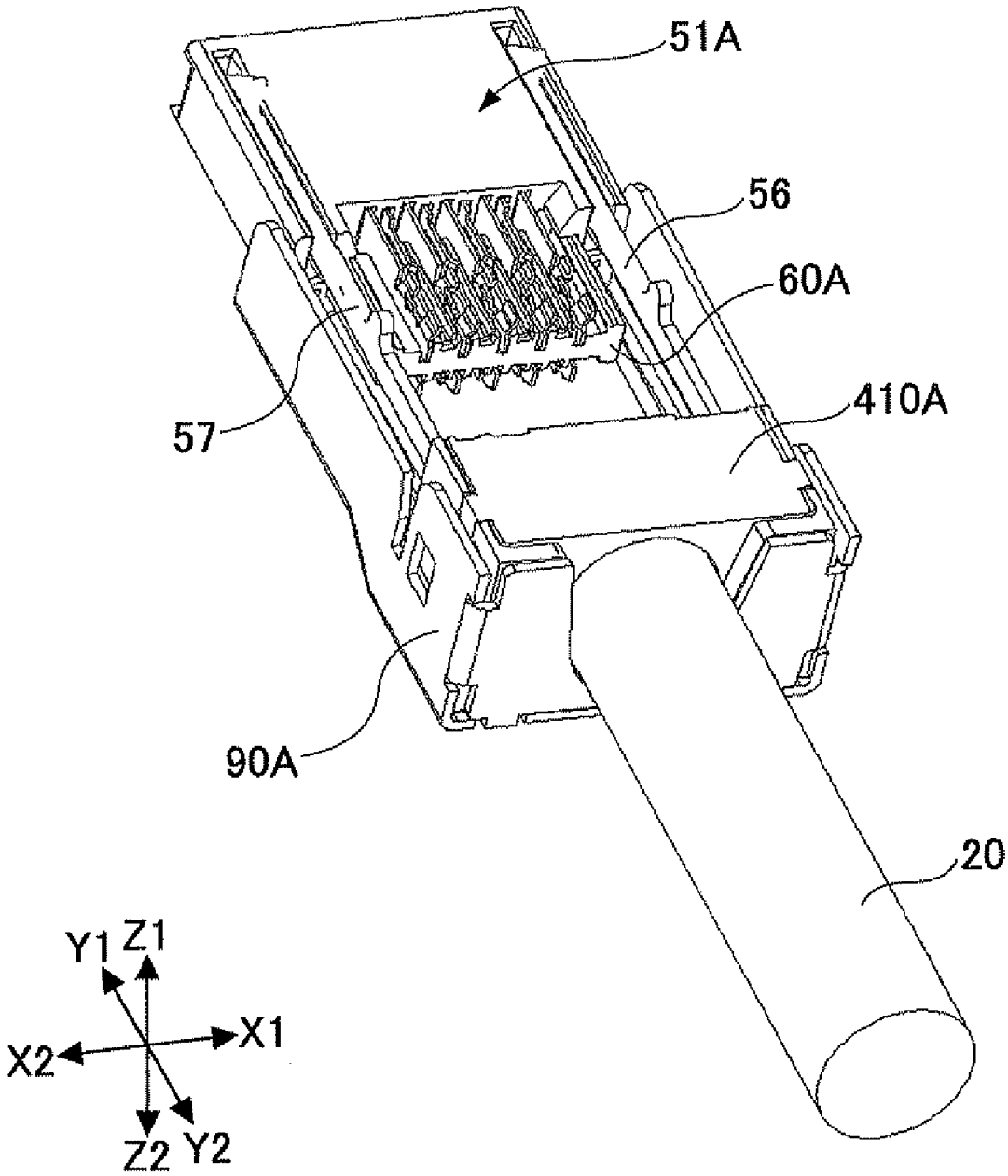
FIG. 18 is a perspective view of the balanced transmission cable connector where a first shield cover 81A is removed.
Figure 19:
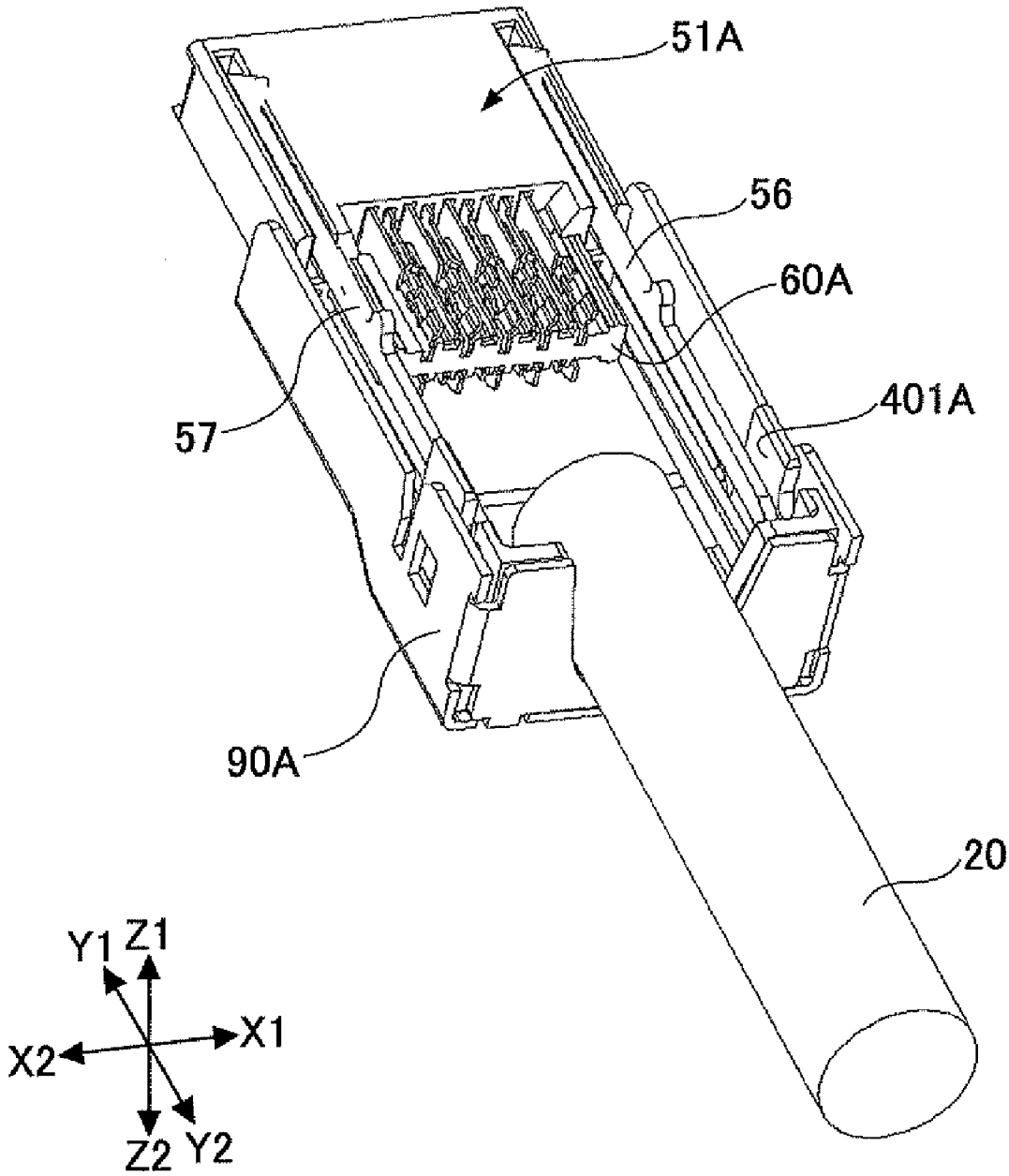
FIG. 19 is a perspective view where a second inner cap 410A in FIG. 18 is removed.
Figure 20:
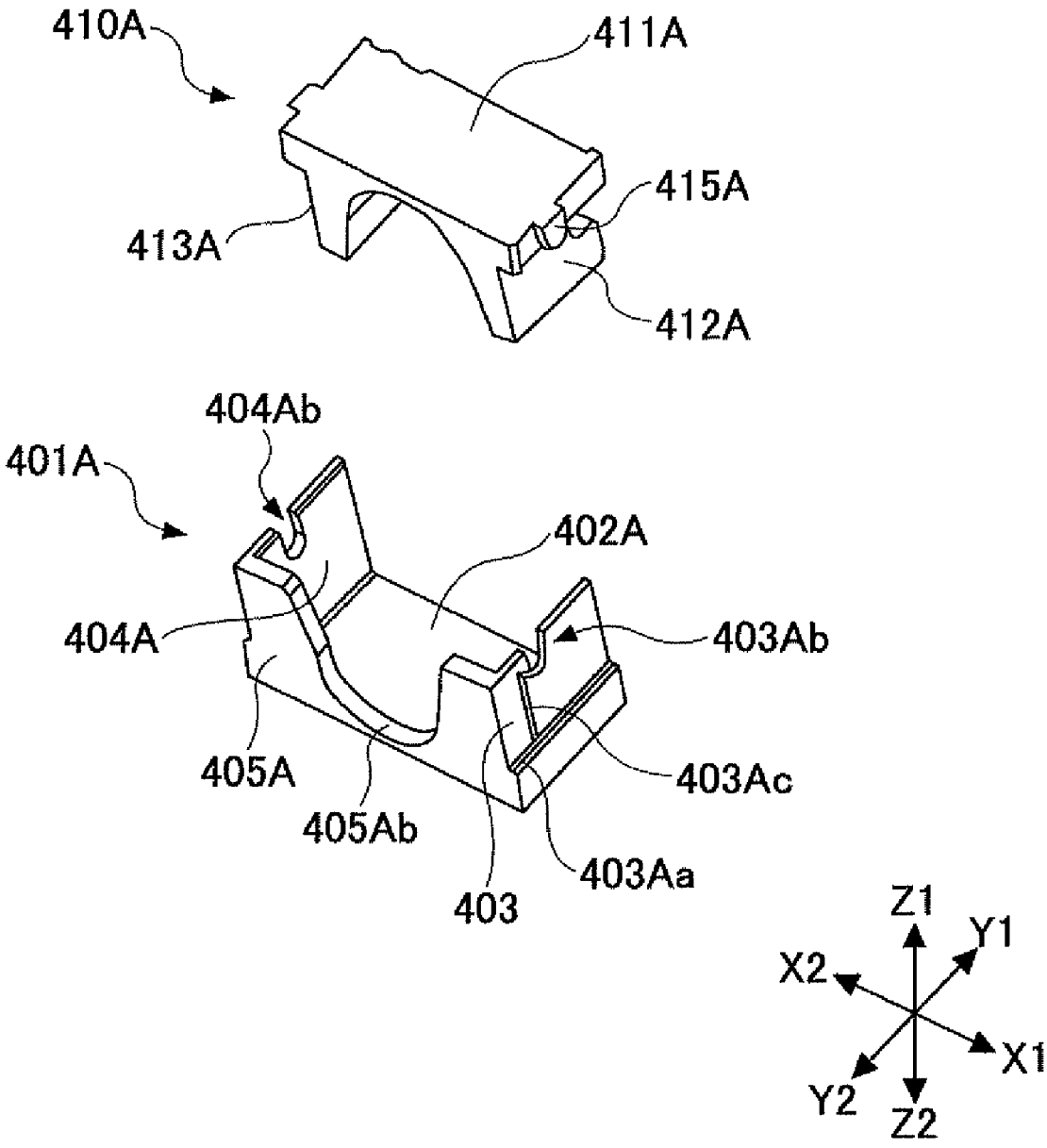
FIG. 20 is an exploded perspective view of an inner cap 400A.
Figure 21:
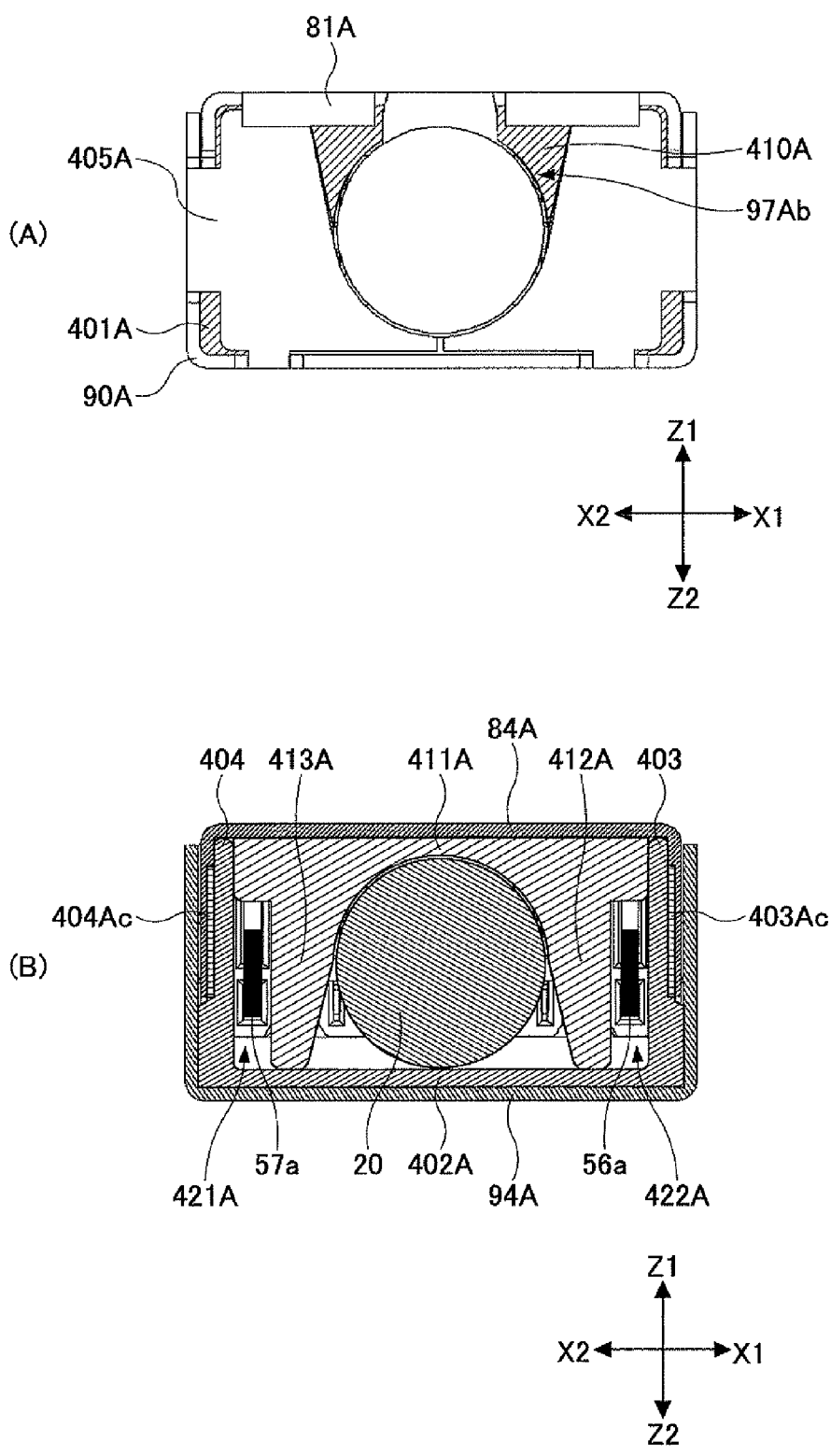
FIG. 21 is a view illustrating where a gap at a Y2 side of the shield assembly body 80A is closed.

FIG. 18 is a perspective view of the balanced transmission cable connector where the first shield cover 81A is removed. FIG. 19 is a perspective view where a second inner cap half 410A in FIG. 18 is removed. FIG. 20 is an exploded perspective view of the inner cap 400A. FIG. 21 is a view illustrating a state where a gap at the Y2 side of the shield assembly body 80A is closed. FIG. 21(A) is an external view seen from the Y2 side and FIG. 21(B) is a cross-sectional view seen from the Y2 side.

As illustrated in FIG. 20, the inner cap 400A includes the second inner cap half 410A at the Z1 side and a first inner cap half 401A at the Z2 side. As illustrated in FIG. 18 and FIG. 19, the first inner cap half 401A and the second inner cap half 410A are synthetic resin molded articles. The first inner cap half 401A and the second inner cap half 410A are combined so as to be arranged in a part of the Y2 end of the inside of the shield cover assembly body 80A, namely a part where the balanced transmission cable 20 is provided in the shield cover assembly body 80A. As a result of this, a space at the Y2 side of the shield cover assembly body 80A is closed.

As illustrated in FIG. 20 and FIG. 21, the first inner cap half 401A includes a base plate part 402A at the Z2 side, a pair of engaging parts 403A and 404A one at each side (X1 side and X2 side), and a rear plate part 405A at the rear surface side (Y2 side).

A surface of the base plate part 402A comes in contact with a surface of the bottom plate 94A of the second shield cover 90A.

The engaging parts 403A and 404A are engaged with the corresponding internal surfaces of the side walls of the shield cover assembly body 80A. The engaging parts 403A and 404A include step parts 403Aa and 404Aa, respectively. Notch parts 403Ab and 404Ab are at the Z2 end of the engaging parts 403A and 404A.

Ribs 403Ac and 404Ac are provided on the external surfaces of the engaging parts 403A and 404A, respectively. The ribs 403Ac and 404Ac extend in the Z1 direction from the step parts 403Aa and 404Aa so as to come in contact with the side surfaces of the first shield cover 81A with a force.

The rear plate part 405A includes a window part 405Ab having a substantially semicircular-shaped configuration. The balanced transmission cable 20 is inserted into the window part 405Ab.

As illustrated in FIG. 20 and FIG. 21, the second inner cap half 410A includes the base plate part 411A at the Z1 side and a pair of facing parts 412A and 413A one at each side (X1 side and X2 side).

A surface of the base plate part 411A comes in contact with a surface of the top plate part 84A of the first shield cover 81A. A projection part 415A is formed on each of X1 and X2 end surfaces of the base plate part 411A. The projection parts 415A are pressed into and engaged with the notch parts 403Ab and 404Ab.

External surfaces of the facing parts 412A and 413A face internal surfaces of the corresponding engaging parts 403A and 404A with separation. Ends (U-shaped configuration parts 56*a* and 57*a*) of the lock arms 56 and 57 are received in spaces 422A and 421A, respectively, existing between the external surfaces of the facing parts 412A and 413A and the internal surfaces of the engaging parts 403A and 404A. In addition, the balanced transmission cable 20 is inserted between the facing parts 412A and 413A.

Thus, the ribs 403Ac and 404Ac provided on the external surface of the inner cap 400A are pressed and come in contact with the internal surface of the shield assembly body 80A so that spaces between the X1 side surface and the X2 side surface of the shield cover assembly body 80A and the X1 side surface and the X2 side surface of the inner cap 400A respectively, are closed.

In addition, the window part 97Ab at the Y2 side of the shield cover assembly body 80A is closed by the Y2 side surfaces of the pair of the facing parts 412A and 413A of the second inner cap half 410A and the balanced transmission cable 20.

With this structure, the space at the Y2 side of the shield cover assembly body 80A can be closed. Hence, when the hood 100 and the outer cover 110 are outsert molded, it is possible to prevent the resin from flowing to the inside of the shield assembly body 80A.

Figure 22:
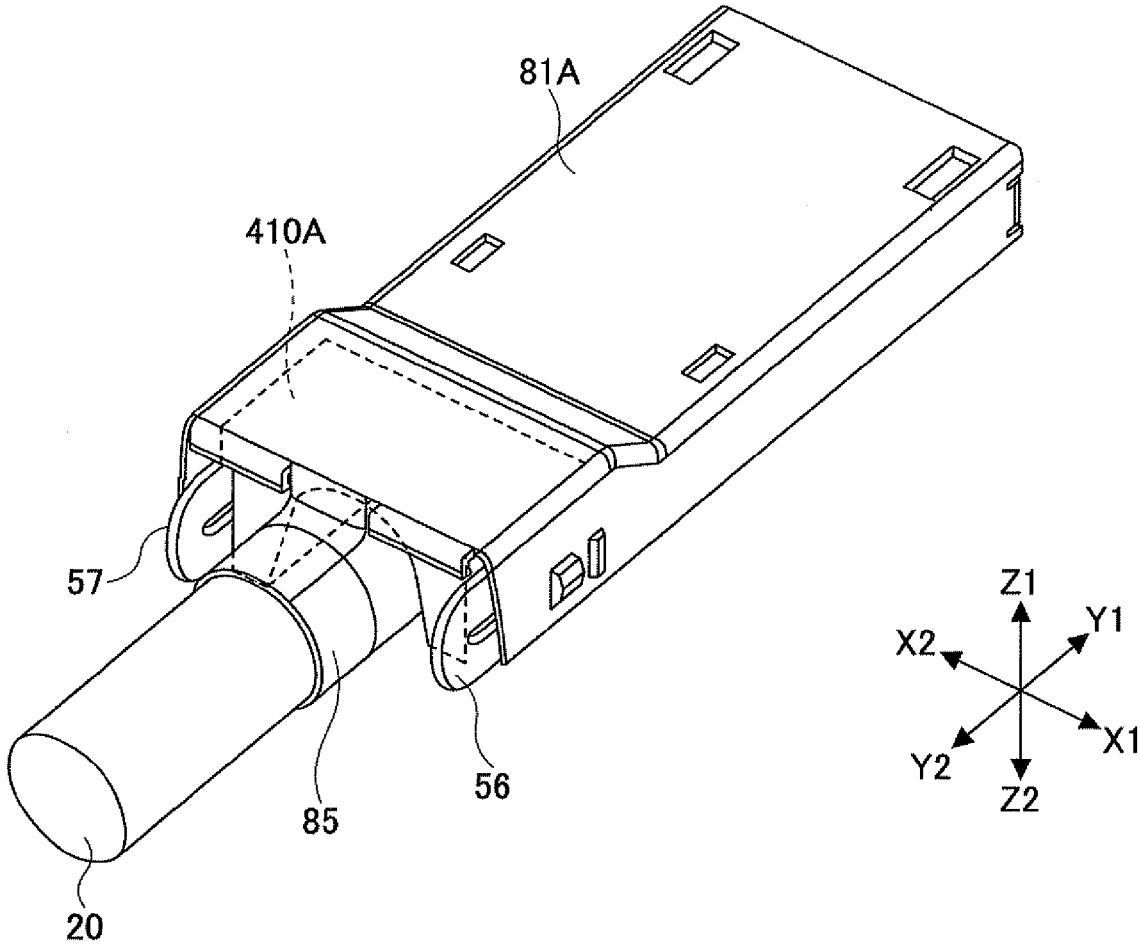
FIG. 22 is a perspective view illustrating a part of an assembling process of the balanced transmission cable connector.

Next, an assembling process of the balanced transmission cable connector is discussed with reference to FIG. 22. Here, FIG. 22 is a perspective view illustrating a part of the assembling process of the balanced transmission cable connector.

First, the second inner cap half 410A is pushed into the first shield cover 90A. Then, while the end of the balanced transmission cable 20 is clamped by the ring part 85, as illustrated in FIG. 22, the contact assembly body 51A which is connected to the end of the balanced transmission cable 20 is provided in the second inner cap half 410A.

Next, the first inner cap half 401A and the second inner cap half 410A are combined so that the inner cap 400A is assembled.

Finally, the first inner cap half 401A is covered with the second shield cover 90A so that the second shield cover 90A is engaged with the first shield cover 81A. Thus, the shield cover assembly body 80A is assembled.

As illustrated in FIG. 21(B), between the internal surface of the first shield cover 81A and the external surface of the second inner cap half 410A, a pair of the spaces 421A and 422A exists. A pair of the lock arms 56 and 67 can be inserted in the Y1 direction from the Y2 side into the spaces 421A and 422A. Therefore, as illustrated in FIG. 22, when the contact assembly body 51A connected to the end of the balanced transmission cable 20 is inserted from the Y2 side in the Y1 direction, there is no need to elastically deform the pair of the lock arms 56 and 57 and therefore it is possible to improve the assembling operations.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

What is claimed is:

1. A balanced transmission cable connector, comprising:

a balanced transmission cable including a plurality of pair electric wires, each of the pair electric wires including a first signal wire, a second signal wire, and a drain wire;

a contact assembly body having an insulative block body where first and second signal contacts and a ground contact are alternately arranged in a row direction, the first and second signal contacts facing each other in a line direction, the block body having a rear surface side at which first and second signal wire connecting parts being parts of the first and second signal contacts and a drain wire connecting part and a plate-shaped part being a part of the ground contact are exposed;

an insulative spacer provided at the rear surface side of the block body, and including a first groove part where the first signal wire connecting part is provided, a second groove part where the second signal wire connecting part is provided, and a slit where the plate-shaped part is provided, wherein the first signal wire connecting part and the second signal wire connecting part include side plate parts facing side surfaces of the first groove part and the second groove part, respectively, with separation;

the first signal wire and the second signal wire are arranged and positioned between the side plate parts of the first signal wire connecting part and the second signal wire connecting part, and the side surfaces of the first groove part and the second groove part, respectively;

the drain wire connecting part includes a side plate part facing a side surface of the slit with separation; and the drain wire is directly sandwiched by the side plate part of the drain wire connecting part and the side surface of the slit.

2. The balanced transmission cable connector as claimed in claim 1, wherein the insulative spacer further includes a pair of projection parts provided on the side surfaces of each of the first groove part and the second groove part at the rear surface sides of the block body, and the pair of projection parts is configured to project toward each other and sandwich an end portion of each of the first signal wire connecting part and the second signal wire connecting part.

3. The balanced transmission cable connector as claimed in claim 1, further comprising:

a pair of lock arms each of the lock aims having a hook part configured to be engaged with an opponent connector where the balanced transmission cable connector is connected, and each of the lock arms having an end supported by the contact assembly body;

a shield cover assembly body configured to surround the contact assembly body, the pair of the lock arms, and the insulative spacer;

an outer cover configured to cover the shield cover assembly body; and an inner cap provided inside the shield cover assembly body, the inner cap being configured to close a space of a rear surface side of the shield cover assembly body, wherein the shield cover assembly body includes a first shield cover and a second shield cover;

the first shield cover includes a top plate part and a ring part, the ring part being provided at a rear surface side of the first shield cover, the ring part being configured to clamp the balanced transmission cable;

the second shield cover includes a bottom plate part and a rear plate part, the rear plate part being provided at a rear surface side of the second shield cover, the rear plate part being where a window part is formed, the window part being where the balance transmission cable is inserted;

the inner cap includes a first inner cap half and a second inner cap half;

the first inner cap half includes a base plate part having a surface coming in contact with the bottom plate part, a pair of engaging parts one of the engaging parts being provided at each side, the pair of engaging parts being configured to be engaged with a pair of side walls of the shield cover assembly body, and a rear plate part provided at a rear surface side, the rear plate part being where the window part is formed, the window part being where the balanced transmission cable is inserted, the second inner cap half includes a base plate part having a surface coming in contact with the top plate part, and a pair of facing parts one of the facing parts being provided at each side, external surfaces of the pair of the facing parts face corresponding internal surfaces of the pair of the engaging parts with separation;

other ends of the pair of the lock arms are received in corresponding ones of a pair of spaces existing between the external surfaces of the pair of the facing parts and the internal surfaces of the pair of the engaging parts; and the balanced transmission cable is inserted between the facing parts.

4. The balanced transmission cable connector as claimed in claim 2, wherein the pair of projection parts is configured to sandwich the end portion of each of the first signal wire connecting part and the second signal wire connecting part, and each of the side plate parts of the first signal wire connecting part and the second signal wire connecting part, respectively.

5. The balanced transmission cable connector as claimed in claim 3, wherein the insulative spacer further includes a pair of projection parts provided on the side surfaces of each of the first groove part and the second groove part at the rear surface sides of the block body, and the pair of projection parts is configured to project toward each other and sandwich an end portion of each of the first signal wire connecting part and the second signal wire connecting part.

* * * * *